US010131467B2

(12) United States Patent
Luburic

(10) Patent No.: US 10,131,467 B2
(45) Date of Patent: Nov. 20, 2018

(54) CONTAINER WITH INTEGRATED HANDLES

(71) Applicant: BWAY Coropration, Atlanta, GA (US)

(72) Inventor: Frano Luburic, Costa Mesa, CA (US)

(73) Assignee: BWAY CORPORATION, Atlanta, GA (US)

( * ) Notice: Subject to any disclaimer, the term of this patent is extended or adjusted under 35 U.S.C. 154(b) by 0 days.

(21) Appl. No.: 15/179,543

(22) Filed: Jun. 10, 2016

(65) Prior Publication Data

US 2016/0280424 A1 Sep. 29, 2016

Related U.S. Application Data

(63) Continuation-in-part of application No. 14/670,163, filed on Mar. 26, 2015, now Pat. No. 9,669,959, and a continuation-in-part of application No. 29/521,979, filed on Mar. 26, 2015, now Pat. No. Des. 778,519.

(51) Int. Cl.

| | |
|---|---|
| ***B65D 25/00*** | (2006.01) |
| ***B65D 25/28*** | (2006.01) |
| ***B65D 21/02*** | (2006.01) |

(52) U.S. Cl.

CPC ..... *B65D 25/2888* (2013.01); *B65D 21/0233* (2013.01); *B65D 25/2897* (2013.01)

(58) Field of Classification Search

CPC ..... B65D 1/16; B65D 25/2805; B65D 7/04; B65D 25/2897; B65D 25/2888; B65D 21/0233

USPC ..... 220/771

See application file for complete search history.

(56) References Cited

U.S. PATENT DOCUMENTS

| | | | | |
|---|---|---|---|---|
| 3,198,377 | A | 8/1965 | Buckley | |
| 3,379,341 | A * | 4/1968 | Miles | B65D 21/0219 206/508 |
| D220,973 | S | 6/1971 | Yates | |
| 3,829,926 | A | 8/1974 | Salladay | |
| D236,320 | S | 8/1975 | Renou | |
| 4,357,042 | A | 11/1982 | Gall | |
| 4,431,326 | A | 2/1984 | Braithwaite et al. | |
| 4,967,918 | A | 11/1990 | Long et al. | |
| 5,207,348 | A | 5/1993 | Fischer et al. | |
| 5,292,024 | A * | 3/1994 | Koefelda | B65D 1/42 206/519 |
| D352,143 | S | 11/1994 | Arshinoff | |
| 5,390,818 | A | 2/1995 | LaBuda | |
| 5,456,357 | A | 10/1995 | Wenner et al. | |
| 5,547,104 | A | 8/1996 | Parker | |
| 5,735,422 | A | 4/1998 | Binter et al. | |
| 5,803,303 | A | 9/1998 | Timm et al. | |

(Continued)

*Primary Examiner* — Ernesto Grano

(74) *Attorney, Agent, or Firm* — Morris, Manning & Martin, LLP; Daniel E. Sineway, Esq.; Bryan D. Stewart, Esq.

(57) ABSTRACT

An exemplary container for storing and transporting materials is disclosed. In various embodiments, the exemplary container includes one or more handles for assisting a user with lifting the exemplary container and/or controlling the exemplary container when pouring the exemplary container's contents. The one or more handles, in particular embodiments, are designed for minimum interference with other similar containers during transport. In some embodiments, certain handles are recessed within a cavity of a sidewall of the exemplary container.

25 Claims, 19 Drawing Sheets

(56) References Cited

U.S. PATENT DOCUMENTS 5,806,709 A 9/1998 Marshall
5,964,372 A 10/1999 Dubois et al.
D430,459 S 9/2000 Conti
6,199,718 B1 3/2001 Ellis et al.
6,308,858 B1 10/2001 Koefelda et al.
6,471,221 B1 10/2002 McGarry et al.
D469,233 S 1/2003 Begnani
D493,929 S 8/2004 Schwarz
6,808,081 B1 10/2004 Citro
7,172,088 B2 2/2007 McDade et al.
D545,519 S 6/2007 King
7,399,017 B1 7/2008 Lasseigne et al.
D590,561 S * 4/2009 Baltz ..... D32/53
D623,373 S 9/2010 Rockwell, III et al.
D626,303 S 10/2010 Loverbos
7,938,292 B2 5/2011 Chornenky et al.
8,210,391 B2 * 7/2012 Luburic ..... B65D 1/16 206/508
8,256,640 B2 * 9/2012 Luburic ..... B29C 45/37 220/669
8,281,952 B2 10/2012 Robellard et al.
8,438,921 B1 5/2013 Bland
D683,920 S 6/2013 Bonafide
D684,327 S 6/2013 Bonafide
D684,328 S 6/2013 Vasilakes et al.
8,459,490 B1 6/2013 McTaggart et al.
D688,018 S 8/2013 Duquenoy
8,757,428 B2 6/2014 Daudelin et al.
D709,263 S 7/2014 Carnesecca
8,806,803 B1 8/2014 Mitchell et al.
8,881,930 B2 11/2014 Banik
D726,385 S 4/2015 O'Leary et al.
9,067,462 B1 6/2015 Pressler et al.
D739,626 S 9/2015 Condiff
D739,627 S 9/2015 Condiff
D743,136 S 11/2015 Condiff
D782,768 S 3/2017 Luburic
2003/0116577 A1 6/2003 Slongo et al.
2003/0168460 A1 9/2003 Von Holdt, Sr. et al.
2006/0175340 A1 8/2006 Garone et al.
2006/0243736 A1 11/2006 Kline et al.
2007/0084870 A1 4/2007 Luburic et al.
2007/0119854 A1 5/2007 Rittmann et al.
2009/0032542 A1 2/2009 Temple et al.
2009/0266738 A1 10/2009 Dunford et al.
2011/0163107 A1 7/2011 Saunders et al.
2013/0116577 A1 * 5/2013 Yazicioglu ..... A61B 5/04017 600/483
2014/0027454 A1 1/2014 Banik et al.
2014/0076893 A1 3/2014 Cheek et al.
2014/0097586 A1 4/2014 Enguita et al.
2014/0327258 A1 11/2014 Ring et al.
2014/0374425 A1 12/2014 Duckett
2015/0225124 A1 8/2015 Persson et al.
2015/0321796 A1 11/2015 O'Leary et al.
2015/0360818 A1 12/2015 Condiff

* cited by examiner

CONTAINER WITH INTEGRATED HANDLES

CROSS REFERENCES TO RELATED APPLICATIONS

This application is a continuation-in-part application of, and claims priority to, U.S. patent application Ser. No. 14/670,163 filed Mar. 26, 2015, entitled "CONTAINER WITH INTEGRATED HANDLES" and U.S. Design patent application Ser. No. 29/521,979, entitled "CONTAINER WITH INTEGRATED HANDLES", filed on Mar. 26, 2015, the disclosures of which are incorporated by reference as if the same were fully set forth herein.

TECHNICAL FIELD

This disclosure relates generally to containers for transporting goods and materials, including consumer goods.

BACKGROUND

There are many industrial containers in usage today. These containers may be used for the containment and shipping of various substances including, but not limited to, food, paints, oils, consumer goods, construction materials, inks, chemicals, lubricants, adhesives, coatings, roofing mastics, driveway sealers, flavorings, sanitation supplies, building products, ice melt compounds, powders, pet food, and other materials. Such containers may come in a variety of sizes and may hold various amounts of material, including, in some cases, four or more gallons. Further, these containers may include a carrying handle that may be shipped separately and attached to the sides of the container to aid in carrying and dispensing the contents of the container.

The containers mentioned above may be convenient for shipping and storing goods, but may prove difficult for use by the end user. For example, even with a carrying handle, it may be difficult for a consumer to pour or control a four gallon bucket of pet food due to the weight of the container and the material. Further, when handles are included with containers to assist an end user with pouring or controlling a container, these handles may interfere with one another when multiple containers are optimally arranged for shipment (e.g., on a pallet or the like).

SUMMARY

According to particular embodiments, a container including a) a bottom; b) a sidewall, wherein an upper portion of the sidewall defines an opening; c) a bumper assembly, projecting outwardly from the sidewall below the upper portion; d) at least one upper handle projecting outwardly from the bumper assembly, the at least one upper handle defines a void between the handle and the sidewall; and e) at least one lower hand-grip comprising a cavity extending inwardly.

In various embodiments, a container including: a) a substantially rectangular bottom; b) a sidewall extending upwardly from the bottom and defining an opening; and c) at least one lower hand-grip proximate the substantially rectangular bottom formed by the sidewall comprising a lower handle and a lower cavity, wherein the lower cavity perimeter extends inwardly from the sidewall into the opening.

In some embodiments, a rectangular container for storing, carrying, or transporting materials, the rectangular container including: a) a substantially rectangular bottom; b) a sidewall extending upwardly from the rectangular bottom, wherein: i) an upper portion of the sidewall defines an opening; and ii) a lower portion of the sidewall defines at least one cavity extending inwardly from the sidewall and a lower hand-grip within the cavity; and c) a bumper assembly extending in a substantially perpendicular direction from the sidewall and comprising a bail ear for attaching a handle, a right upper handle located at a first particular distance from the upper portion of the sidewall, and a left upper handle located at a second particular distance from the upper portion of the sidewall, wherein the first particular distance is a greater distance from the upper portion of the sidewall than the second particular distance.

In a particular embodiment, a container comprising: a) a substantially circular bottom; b) a sidewall extending perpendicular to the substantially circular bottom and terminating with an integrally formed upper lip, wherein an upper portion of the sidewall defines an opening; c) an upper satellite ring coupled to the sidewall below the upper lip, the upper satellite ring extending outward from the sidewall at a downward angle; d) a lower satellite ring coupled to the sidewall below the upper satellite ring, the lower satellite ring extending outward from the sidewall and shaped to receive an upper lip of another container; e) left and right curved handles integrally formed with the upper and lower satellite rings, wherein the left and right curved handles extend below the lowest point of the lower satellite ring; and f) left and right arcuate hand-grips extending from an exterior surface of the substantially circular bottom into an interior of the container, wherein a radius of the left curved hand-grip is substantially parallel to a radius of the left curved handle.

According to at least one aspect, a container comprising: a) a substantially circular bottom; b) a sidewall extending perpendicular to the substantially circular bottom and terminating with an integrally formed upper lip, wherein an upper portion of the sidewall defines an opening; c) an upper satellite ring coupled to the sidewall below the upper lip, the upper satellite ring extending outward from the sidewall at a downward angle; d) a lower satellite ring coupled to the sidewall below the upper satellite ring, the lower satellite ring extending outward from the sidewall and shaped to receive an upper lip of another container; e) at least one curved handle integrally formed with the upper and lower satellite rings, wherein the at least one curved handle extends below the lowest point of the lower satellite ring; and f) at least one arcuate hand-grip extending from an exterior surface of the substantially circular bottom into an interior of the container, wherein a radius of the at least one curved hand-grip is substantially parallel to a radius of the at least one curved handle.

In a particular aspect, a container comprising: a) a substantially circular bottom; b) a sidewall extending perpendicular to the substantially circular bottom and terminating with an integrally formed upper lip, wherein an upper portion of the sidewall defines an opening; c) a satellite ring coupled to the sidewall below the upper lip, the satellite ring extending outward from the sidewall and shaped to receive an upper lip of another container; d) at least one curved handle integrally formed with the satellite ring, wherein the at least one curved handle extends below the lowest point of the satellite ring; and e) at least one arcuate hand-grip extending from an exterior surface of the substantially circular bottom into an interior of the container, wherein a radius of the at least one curved hand-grip is substantially parallel to a radius of the at least one curved handle and a radius of the satellite ring.

BRIEF DESCRIPTION OF THE DRAWINGS

Further features and benefits of the present disclosure will be apparent from a detailed description of various embodiments thereof taken in conjunction with the following drawings, wherein similar elements are referred to with similar reference numbers, and wherein.

DETAILED DESCRIPTION

The above and further features of the disclosed exemplary container will be recognized from the following detailed descriptions and drawings of particular embodiments. In various embodiments, a container with upper and lower handles that minimize conflict or interference with adjacent containers is disclosed. In particular embodiments, the container includes a bumper assembly, upper handles (which may or may not be vertically off-set) and one or more lower hand-grips. In further embodiments, the container includes one or more lower hand-grips and no upper handles. According to at least one embodiment, the container is substantially rectangular in shape. In one or more embodiments, the container is substantially circular in shape.

The container discussed herein may be formed in any suitable way. In various embodiments, the container is formed by injection molding. In particular embodiments, the container is 3D printed or created via other additive manufacturing means. In further embodiments, various components of the container are formed or created separately and the various components of the container are joined or otherwise suitably connected to form the container.

As will be understood by one of ordinary skill in the art, the container discussed herein may be used for storing or transporting any variety of materials, including, but not limited to: food, paints, oils, consumer goods, construction materials, inks, chemicals, lubricants, adhesives, coatings, roofing mastics, driveway sealers, flavorings, sanitation supplies, building products, ice melt compounds, powders, pet food, and other such materials. The container may be formed from any suitable material or materials for storing or transporting such materials. In various embodiments, the container is manufactured from plastic (e.g., polyethylene, high-density polyethylene, etc.). In particular embodiments, the container is manufactured from a metal or composite material.

Such an exemplary container may provide a number of uses. In embodiments that include upper handles, the upper handles may assist a user or users (e.g., one user on each side of the container) in lifting the container into or out of a shopping cart or car trunk, onto or off of a shelf, etc. In embodiments that include lower hand-grips, which, in some embodiments, are ergonomically designed, a user may more easily pour the contents of the container.

Figure 1:
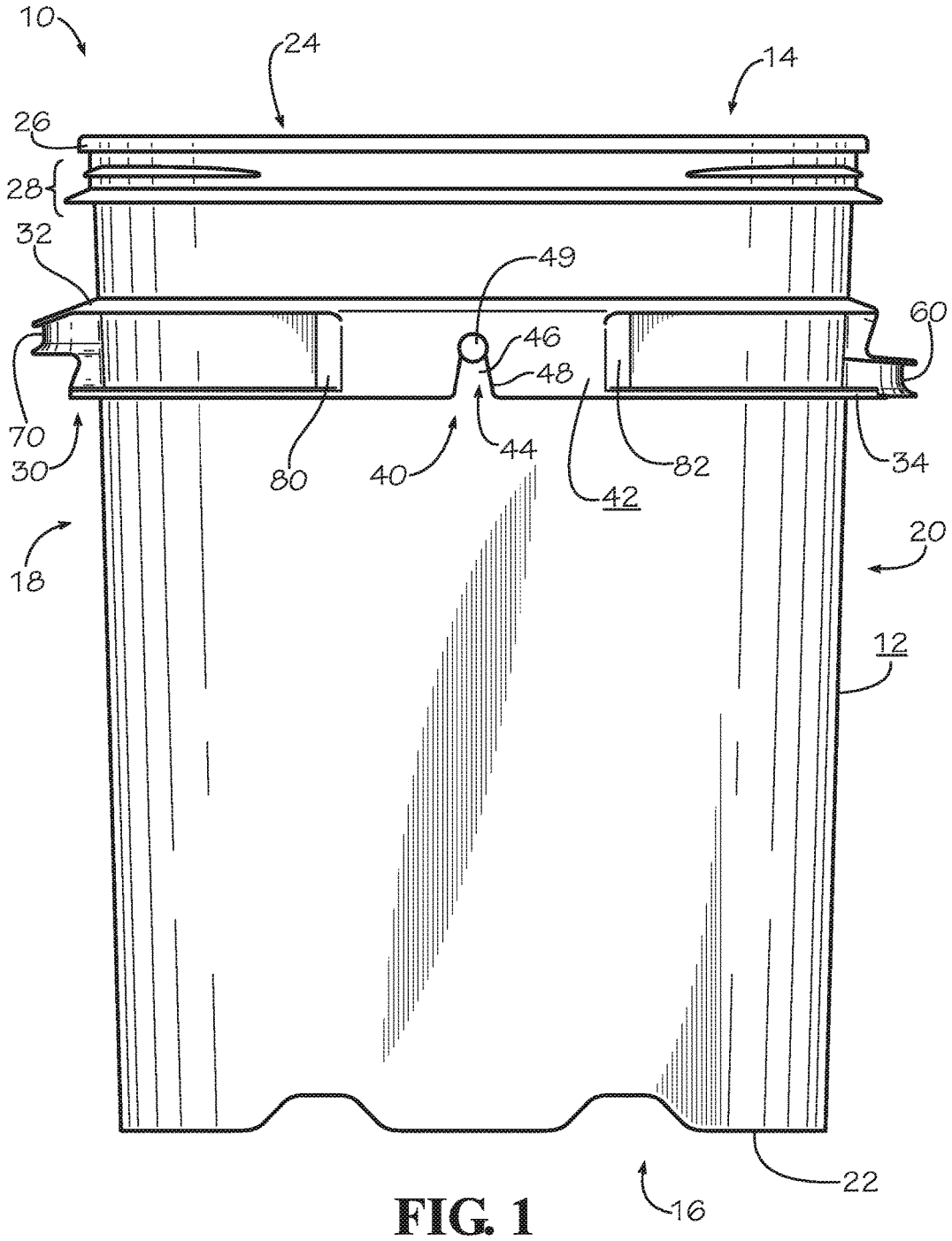
FIG. 1 is front view of an exemplary container, according to one embodiment of the present disclosure.

Turning now to an exemplary container illustrated in the figures, FIG. 1 depicts a front-view of an exemplary container 10, according to one embodiment. In the embodiment shown in FIG. 1, the exemplary container includes a container body 12 with a proximal end 14 (top), a distal end 16 (bottom), a left side 18, and a right side 20. In the embodiment shown, the exemplary container 10 includes a bottom 22 approximate the distal end 16 for sealing the exemplary container and defining an interior cavity. The exemplary container 10, in particular embodiments, includes an opening 24 near the proximal end 14.

In various embodiments, the exemplary container 10 includes various features near the proximal end 14. In particular embodiments, the exemplary container 10 includes an angled bead 26 for interlocking or attaching a cover or lid near the proximal end 14. In some embodiments, the exemplary container 10 includes one or more satellite rings 28, located and generally formed near the proximal end of the body 12. In particular embodiments, the one or more satellite rings extend fully or partially around the body 12 of the exemplary container 10.

According to at least one embodiment, the exemplary container 10 includes a bumper assembly 30. The bumper assembly 30, in particular embodiments, includes an upper bumper satellite ring 32, a lower bumper satellite ring 34, an upper left handle 60 (left side 18), an upper right handle 70 (right side 20), and one or more bail ear assemblies 40 formed between the upper bumper satellite ring 32 and the lower bumper satellite ring 34. As will be understood by one of ordinary skill in the art, the bumper assembly 30 may include more than two satellite rings (or less than two satellite rings) in particular embodiments.

The upper bumper satellite ring 32 and the lower bumper satellite ring 34 may generally be for protecting the container 10 when it comes in contact with another object. Further, the upper bumper satellite ring 32 and the lower bumper satellite ring 34 form the upper left handle 70 (more particularly described below in relation to FIG. 3), the upper right handle 60 (more particularly described below in relation to FIG. 2) and the bail ear assembly 40. As shown in FIG. 1, the upper left handle 70 and the upper right handle 60 are not at the same vertical location. In this embodiment (and others), these handles are offset from each other such that when two containers are placed next to each other (nested) they can be very close together without the upper handles conflicting. In this way, in this embodiment, more containers with this handle configuration can fit in a smaller space (e.g., because the container can be placed closer together).

As shown in the embodiment of FIG. 1, the bail ear assembly 40 includes a vertical support 42 parallel to an external wall of the body 12. The vertical support 42, in various embodiments, defines an opening 44 that includes a channel portion 46 that tapers from a mouth area 48 and opens into a generally semi-circular seating portion 49. The bail ear assembly 40, in particular embodiments, includes two vertical support structures 80 and 82 that are generally perpendicular to the external sidewall of the body 12. As will be understood by one of ordinary skill in the art, in at least one embodiment, the vertical support 42 and the external wall of the body 12 may not be directly in contact (e.g., such that a handle may be affixed to the bail ear assembly 40). In further embodiments, the bail ear assembly 40 includes internal vertical supports perpendicular to the external wall of the body 12 for supporting the bail ear assembly 40 (not shown in FIG. 1).

Figure 2:
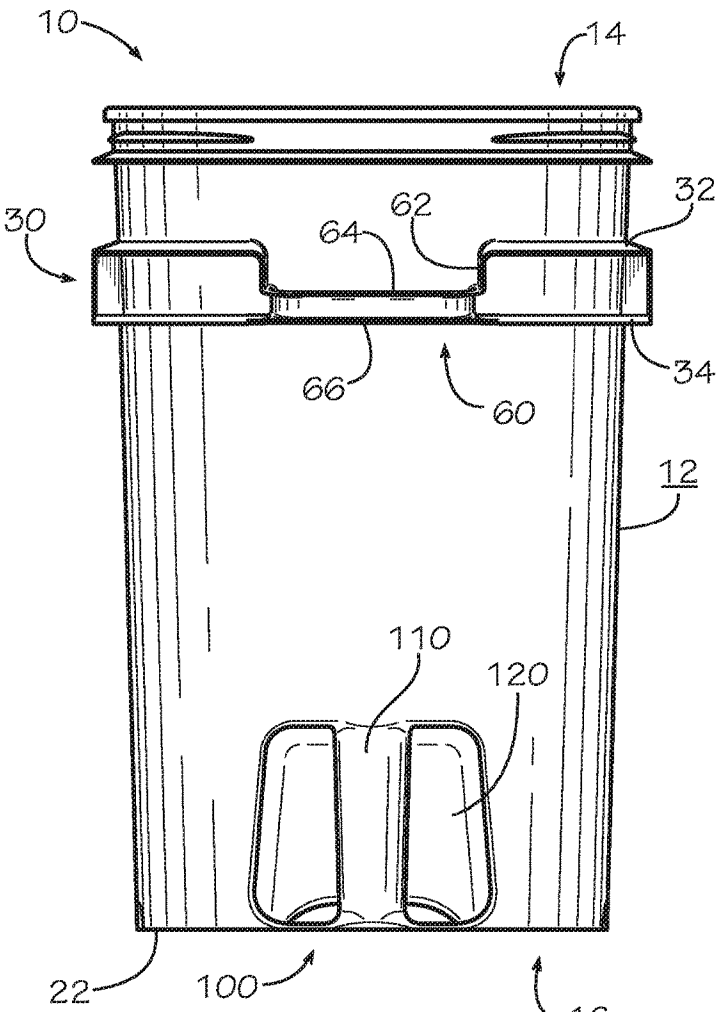
FIG. 2 is a side view of the exemplary container of FIG. 1, according to one embodiment of the present disclosure.

Turning now to FIG. 2, a right side view of the exemplary container 10 of FIG. 1 is depicted. The embodiment shown in FIG. 2 includes the right handle 60, as shown in FIG. 1. In particular embodiments, the right handle 60 is formed such that a consumer can grip the right handle 60 to assist in lifting exemplary container 10 and/or pouring the contents of the exemplary container 10. Thus, many configurations of the right handle 60 are contemplated, but not necessarily shown. In at least one particular embodiment, the right handle 60 may be knob-shaped, angled in an upward direction (e.g., toward the proximal end 14), hook or scoop-shaped, etc.

In a particular embodiment, the right handle 60 is formed between the upper bumper satellite ring 32 and the lower bumper satellite ring 34. In particular embodiments, the upper satellite ring 32 forms a downward slope 62 and an upper surface 64 of the right handle 60 and the lower satellite ring 34 forms a lower surface 66 of the right handle 60. In one embodiment, the slope 62 is formed such that a handle from another container (e.g., a container similar to exemplary container 10, with a left handle) "interlocks" or allows a lower surface of the handle from the other container to slide above the upper surface 64 of right handle 60.

As will be understood by one of ordinary skill in the art, the right handle 60 may be formed in any suitable way, including by injection molding. As will also be understood by one of ordinary skill in the art, the right handle 60 may be formed as an integral part of the exemplary container 10 or may be formed separately and attached to the external sidewall of body 12 by any suitable means, including, but not limited to: by an adhesive, by friction welding, by mechanical fasteners (nails, screws, etc.), etc.

The embodiment shown in FIG. 2 further includes a lower right hand-grip assembly 100. The lower right hand-grip assembly 100 includes a lower right hand-grip 110 and a lower right hand cavity 120. The lower right hand-grip assembly 100 may be used in conjunction with the upper right handle 60 in a lever-type motion to lift the exemplary container 10 or pour its contents (e.g., a consumer may lift the distal end 16 of the exemplary container 16 to assist in pouring the contents of the exemplary container 10). In one embodiment, the lower right hand-grip assembly is substantially similar to the lower left hand grip assembly 200, which is further discussed below in relation to FIGS. 3-5.

Figure 3:
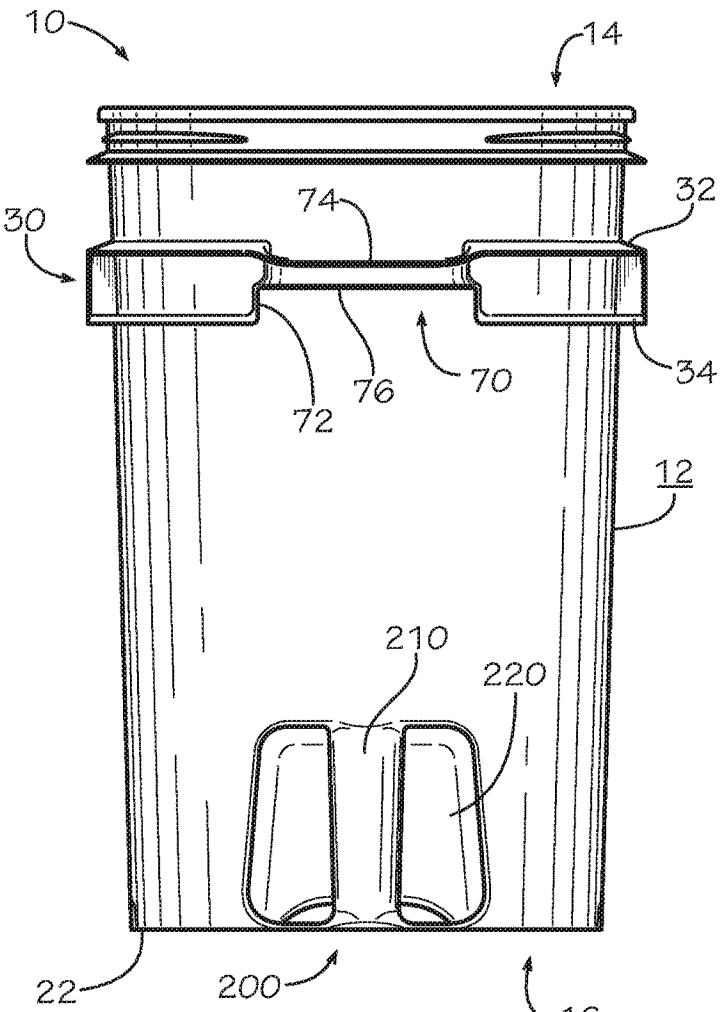
FIG. 3 is a side view of the exemplary container of FIG. 1, according to one embodiment of the present disclosure.

Turning now to FIG. 3, a left side view of the exemplary container 10 of FIG. 1 is depicted. The embodiment shown in FIG. 3 includes the left handle 70, as shown in FIG. 1. In particular embodiments, the left handle 70 is formed such that a consumer can grip the left handle 70 to assist in lifting the exemplary container 10 and/or pouring the contents of the exemplary container 10. Thus, many configurations of the left handle 70 are contemplated, but not necessarily shown. In at least one particular embodiment, the left handle 70 may be knob-shaped, angled in an upward direction (e.g., toward the proximal end 14), hook or scoop-shaped, etc.

In a particular embodiment, the left handle 70 is formed between the upper bumper satellite ring 32 and the lower bumper satellite ring 34. In particular embodiments, the lower satellite ring 34 forms an upward slope 72 and an lower surface 76 of the left handle 70 and the upper satellite ring 32 forms an upper surface 74 of the left handle 70. In one embodiment, the slope 72 is formed such that a handle from another container (e.g., a container similar to exemplary container 10, with a similar right handle) "interlocks" or allows an upper surface of the handle from the other container to slide below the lower surface 764 of left handle 70.

As will be understood by one of ordinary skill in the art, the left handle 70 may be formed in any suitable way, including by injection molding. As will also be understood by one of ordinary skill in the art, the left handle 70 may be formed as an integral part of the exemplary container 10 or may be formed separately and attached to the external sidewall of body 12 by any suitable means, including, but not limited to: by an adhesive, by friction welding, by mechanical fasteners (nails, screws, etc.), etc.

The embodiment shown in FIG. 3 further includes a lower left hand-grip assembly 200. The lower left hand-grip assembly 200 includes a lower left hand-grip 210 and a lower left hand cavity 220. The lower left hand-grip assembly 200 may be used in conjunction with the upper left handle 70 to lift the exemplary container 10 or pour its contents (e.g., a consumer may lift the distal end 16 of the exemplary container 10 to assist in pouring the contents of the exemplary container 10). An exemplary embodiment of the lower left hand-grip assembly 200 is further discussed below in relation to FIGS. 4 and 5.

Figure 5:
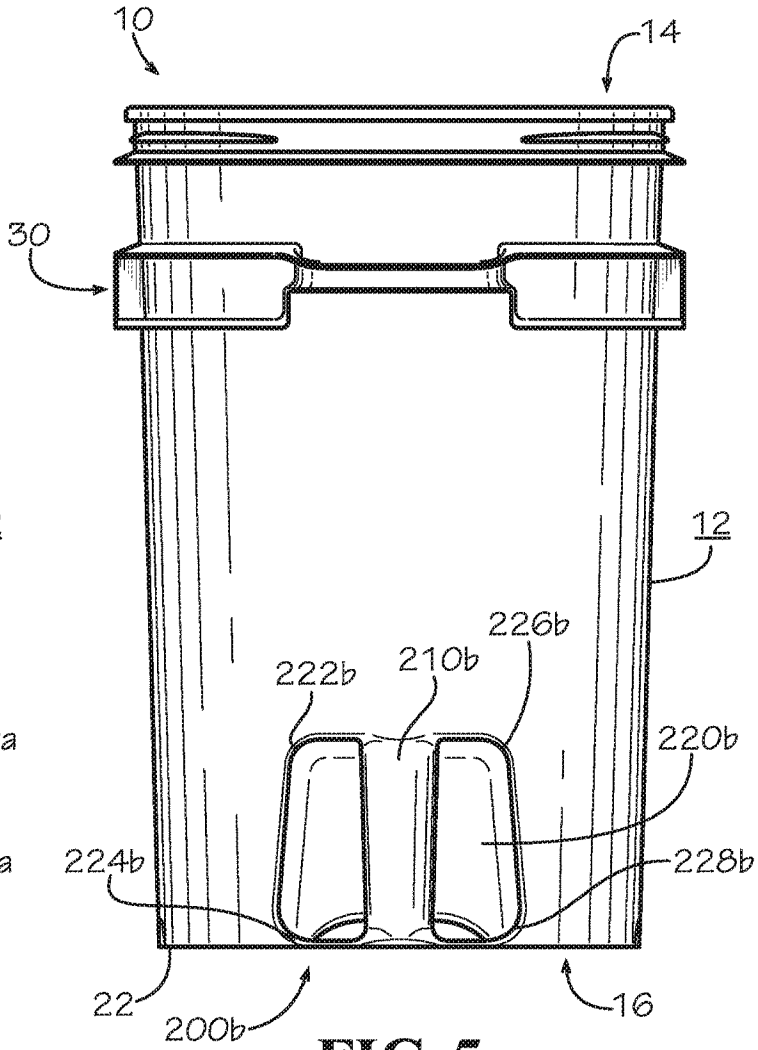
FIG. 5 is a side view of a second alternate exemplary container, according to one embodiment of the present disclosure.
Figure 4:
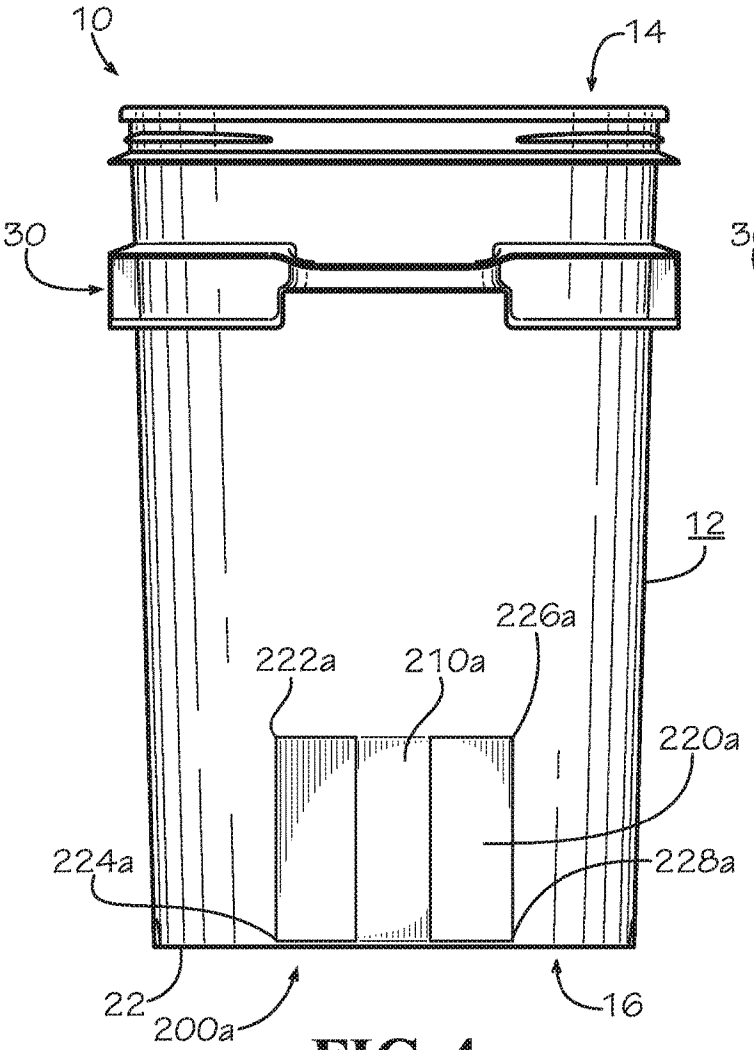
FIG. 4 is a side view of an alternate exemplary container, according to one embodiment of the present disclosure.
Figure 6:
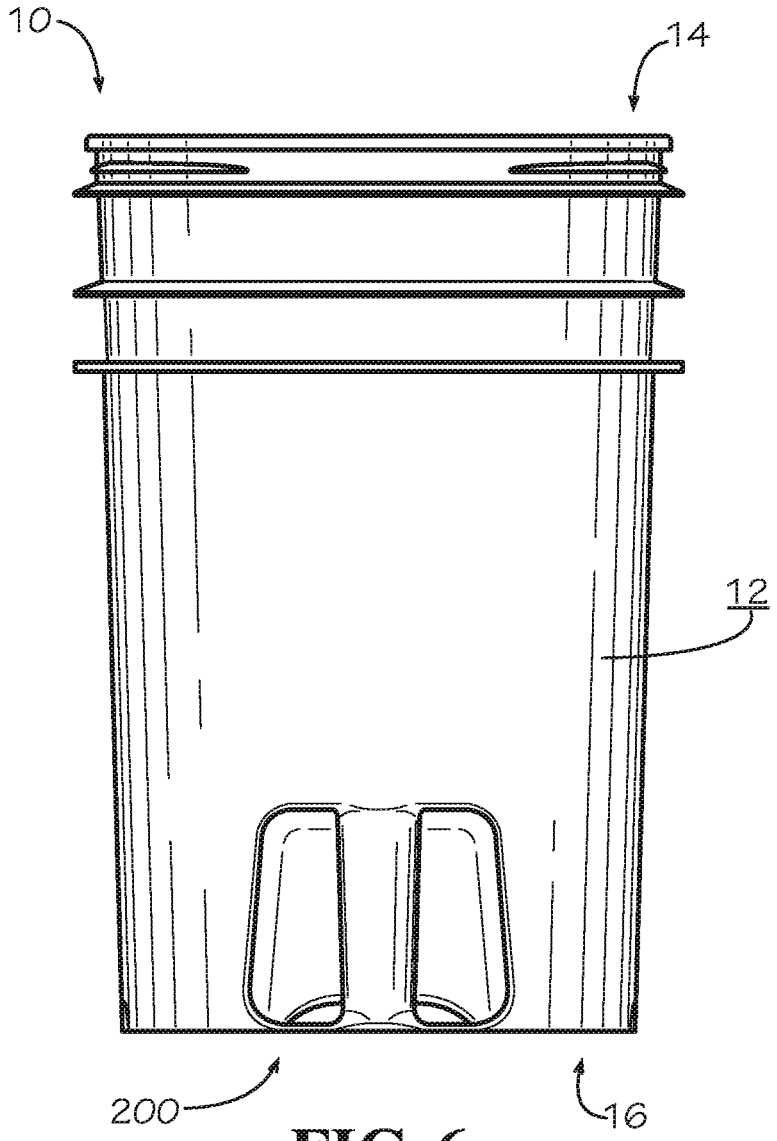
FIG. 6 is a side view of a third alternate exemplary container, according to one embodiment of the present disclosure.

FIGS. 4, 5, and 6 show alternate embodiments of the left side 18 of the exemplary container 10 of FIG. 1. Particularly, FIGS. 4 and 5 show alternate embodiments of the lower left hand-grip assemblies 200*a* and 200*b*, respectively, and FIG. 6 shows an embodiment of the left side 18 of the exemplary container 10 of FIG. 1 without a bumper and upper handle. As will be understood by one of ordinary skill in the art, these alternate embodiments are shown for the left side 18 of the exemplary container 10 of FIG. 1, but substantially similar embodiments are contemplated for the right side 20 of the exemplary container 10 of FIG. 1.

For example, in a particular embodiment, the right side 20 of the exemplary container 10 of FIG. 1 may include alternate embodiments of the lower right hand-grip assembly 100 substantially similar to the alternate embodiments of the lower left hand-grip assembly 200 (as shown in FIGS. 4 and 5). Further, the right side 20 of the exemplary container 10 of FIG. 1 may not include a bumper and upper handle as shown for the left side 18, as shown in FIG. 6. For simplicity and brevity, these alternate embodiments are discussed for the left side only.

Turning now to the embodiment shown in FIG. 4, the body 12 of the exemplary container 10 defines a lower left hand-grip assembly 200*a*. The lower left hand-grip assembly 200*a* includes a lower hand-grip 210*a* and a cavity 220*a*. The lower hand-grip 210*a*, in the embodiment shown, is a substantially circular hand-grip extending vertically from near the distal end 16 of the exemplary container 10. Continuing with the embodiment shown, the lower hand-grip 210*a* is substantially the same diameter for its entire length. In various embodiments, the lower hand-grip 210*a* is formed such that a user or consumer can wrap their hand around at least a portion of the hand-grip 210*a* to assist in lifting and controlling the exemplary container 10 when pouring its contents.

To enable an end-user or consumer to wrap their hand around at least a portion of the hand-grip 210*a*, the cavity 220*a*, in the embodiment shown, is a cavity that extends toward the interior of the exemplary container 10 (e.g., around and at least partially behind the hand-grip 210*a*). As shown in the embodiment in FIG. 4, the body 12 forms the opening to the cavity 220*a* with angles that are substantially 90 degrees. Particularly, the angles 222*a*, 224*a*, 226*a*, and 228*a* are substantially 90 degrees.

Turning now to the embodiment shown in FIG. 5, the body 12 of the exemplary container 10 defines a lower left hand-grip assembly 200*b* (e.g., the lower left hand-grip assembly 200*b* is substantially similar to the lower hand-grip assembly 200 shown in FIG. 3). The lower left hand-grip assembly 200*b* may be ergonomically designed or optimized for an end-user or consumer to hold. The lower left hand-grip assembly 200*b* includes a hand-grip 210*b* and a cavity 220*b*. The lower hand-grip 210*b*, in the embodiment shown, is a substantially circular hand-grip extending vertically from near the distal end 16 of the exemplary container 10. Continuing with the embodiment shown, the lower hand-grip 210*b* varies in diameter along its vertical length (e.g., for ergonomics or other reasons). In the embodiment shown in FIG. 5, the lower hand-grip 210*b* decreases in diameter from the top of the lower hand-grip 210*b* (e.g., the part of the lower hand-grip nearest the proximal end 14 of the exemplary container 10) to the bottom of the lower hand-grip 210*a* (the part of the lower hand-grip nearest the distal end 16 of the exemplary container 10). In various embodiments, the lower hand-grip 210*b* is formed such that a user or consumer can wrap their hand around at least a portion of the hand-grip 210*b* to assist in lifting and controlling the exemplary container 10 when pouring its contents. In particular embodiments, the lower hand-grip 210*a* does not protrude past the body sidewall 12 so that it does not interfere with other containers when shipped or nested. In further embodiments, the lower hand-grip 210*a* may have other features to assist an end-user or consumer with lifting the exemplary container 10, such as, for example, the lower hand-grip 210*a* may be relatively hefty, made of durable material, reinforced at points where it is connected to the rest of exemplary container 10, and/or include non-slip grooves (or other surface finishes), divots for fingers, etc.

To enable an end-user or consumer to wrap their hand around at least a portion of the hand-grip 210*b*, the cavity 220*b*, in the embodiment shown, is a cavity that extends toward the interior of exemplary container 10 (e.g., around and at least partially behind hand-grip 210*b*). As shown in the embodiment in FIG. 6, the body 12 forms a substantially rectangular opening to the cavity 220*b* with angles that are substantially other than 90 degrees. Particularly, the angles 222*b*, 224*b*, 226*b*, and 228*b* may each be any suitable angles such as between about 60 and 120 degrees. For example, the angles 226*b* and 228*b* may be 95 degrees and 85 degrees, respectively. Further, the opening to the cavity 220*b* may form arcs of any suitable length, opposed to substantially square corners (e.g., at 222*b*, 224*b*, 226*b*, and 228*b*).

Turning now to the embodiment shown in FIG. 6, an embodiment of the left side of the exemplary container 10 of FIG. 1, including a lower left hand-grip assembly 200 (e.g., lower left hand-grip assembly 200*a* or 200*b*) is shown. In the embodiment shown in FIG. 6, the exemplary container 10 excludes an upper handle. In various embodiments, the exemplary container 10 may include a bumper assembly (e.g., bumper assembly 30) with no handle. In further embodiments, the exemplary container 10 may not include a bumper assembly.

Figure 7:
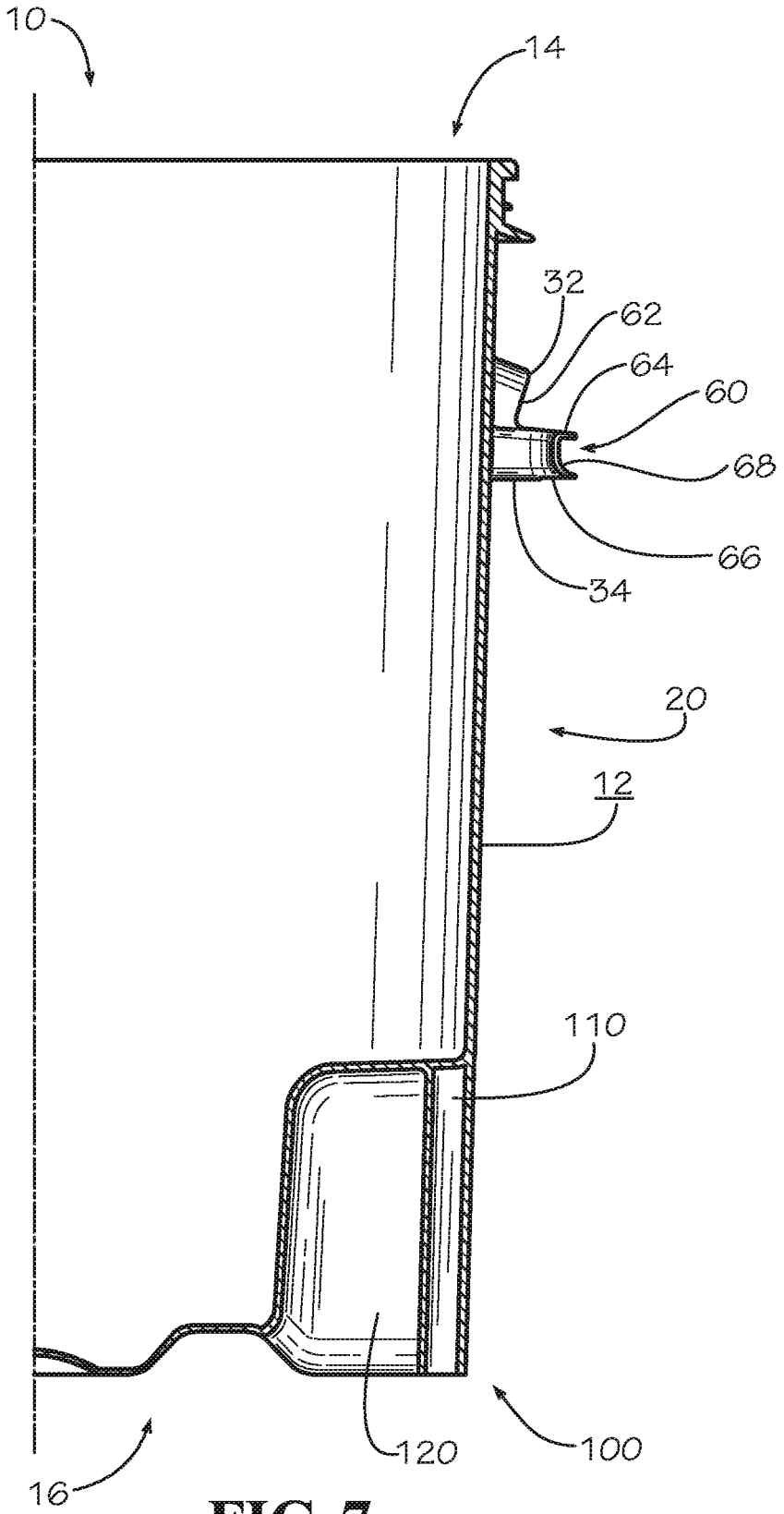
FIG. 7 is a partial cross-sectional view of the exemplary container of FIG. 1, according to one embodiment of the present disclosure.

FIG. 7 depicts a cross-section of the exemplary container 10 of FIG. 1 through the center of the right handle 60 and a vertical axis of lower right hand-grip 110. As will be understood by one of ordinary skill in the art, the embodiments, features, and dimensions are shown and discussed for the right side 20 of the exemplary container 10 of FIG. 1, but substantially similar embodiments, features, and dimensions are contemplated for the left side 18 of the exemplary container 10 of FIG. 1. For simplicity and brevity, these embodiments, features, and dimensions are discussed for the right side 20 only.

Continuing with the embodiment shown in FIG. 7, the upper right handle 60 generally slopes downward toward the distal end 16 of the exemplary container 10. Further, in the embodiment shown in FIG. 7, the upper right handle 60 is formed by the upper satellite ring 32 and the lower satellite ring 34. In various embodiments, the upper satellite ring 32 forms a slope 62 that slopes downward to the upper surface 64 of the upper right handle 60. The upper surface 64 and the lower surface 66 of the upper right handle 60, in various embodiments, creates a substantially c-shaped channel 68, the center of which is substantially parallel to at least a portion of the sidewall 12.

As shown in FIG. 7, the lower right hand-grip assembly 100 includes the lower right hand-grip 110 and the lower right-hand cavity 120. In various embodiments, as shown in FIG. 7, the lower right hand-grip 110 is substantially the same diameter from a top of the lower right hand-grip 110

(e.g. the portion of lower right hand-grip closest to the proximal end 14 of the exemplary container 10) to the bottom of lower right hand-grip 110 (e.g., the portion of lower right hand-grip 110 closest to the distal end 16 of the exemplary container 10) along the axis shown. As will be understood by one of ordinary skill in the art, in particular embodiments, the lower right hand-grip 110 may vary in diameter along this axis. As shown in FIG. 7, the lower right hand-grip 110, other than an exterior surface, is substantially within the lower right cavity 120.

According to particular embodiments, the lower right cavity 120 extends inwardly from the external sidewall of body 12. As will be understood by one of ordinary skill in the art, the lower right cavity 120 may extend any suitable amount inwardly to accommodate a consumer's hand or part of a consumer's hand for gripping the lower right hand-grip 110. In particular embodiments, the lower right cavity 120 may extend inwardly approximately one to five inches. In one embodiment, the lower right cavity 120 extends inwardly approximately three inches. In a further embodiment, the lower right cavity 120 extends inwardly about 0.5 to 6.0 inches. In at least one embodiment, the lower right cavity extends inwardly based on the size of the exemplary container 10. As a particular example, the lower right cavity 120 is larger if the exemplary container 10 is designed to hold four (4) gallons of a material than if the exemplary container 10 is designed to hold one (1) gallon of material.

The lower right cavity 120 may be any suitable shape. In a particular embodiment, the lower right cavity 120 may be substantially cubic shaped, rhomboid shaped, or other regular shape. In various embodiments, the lower right cavity 120 may be an irregular shape, extending from the sidewall (body) 12 inwardly behind the lower right hand-grip 110. In particular embodiments, the lower right cavity 120 may extend from the sidewall (body) 12 on a particular side of the lower right hand-grip 110 and at least partially behind the lower right hand-grip 110, but without a cavity opening on each side of the lower right hand-grip 110 (e.g., the lower right cavity 120 may be designed to accommodate only a portion of a user's hand so as to reduce the volume lost in the exemplary container 10).

Figure 8:
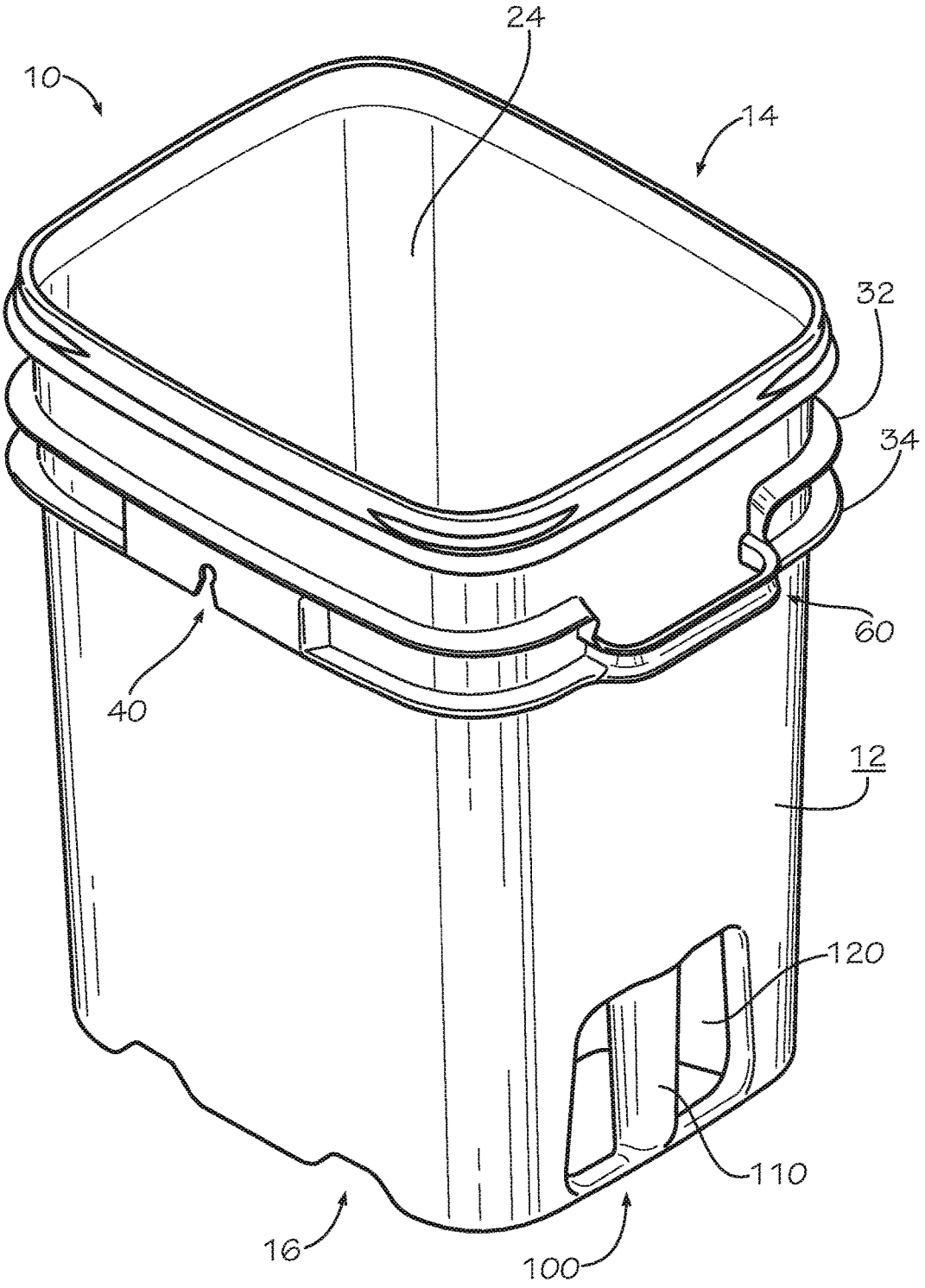
FIG. 8 is a first perspective view of the exemplary container of FIG. 1, according to one embodiment of the present disclosure.

FIG. 8 depicts a first perspective view of the exemplary container 10 of FIG. 1, according to one embodiment. In the embodiment shown, there is a void between the upper right handle 60 and the external sidewall of exemplary container 10 (e.g., sidewall of exemplary body 12). In particular embodiments, this void is sized such that a consumer can place part of their hand or some or all of their fingers between the upper right handle 60 and the external sidewall of the exemplary container 10.

Figure 9:
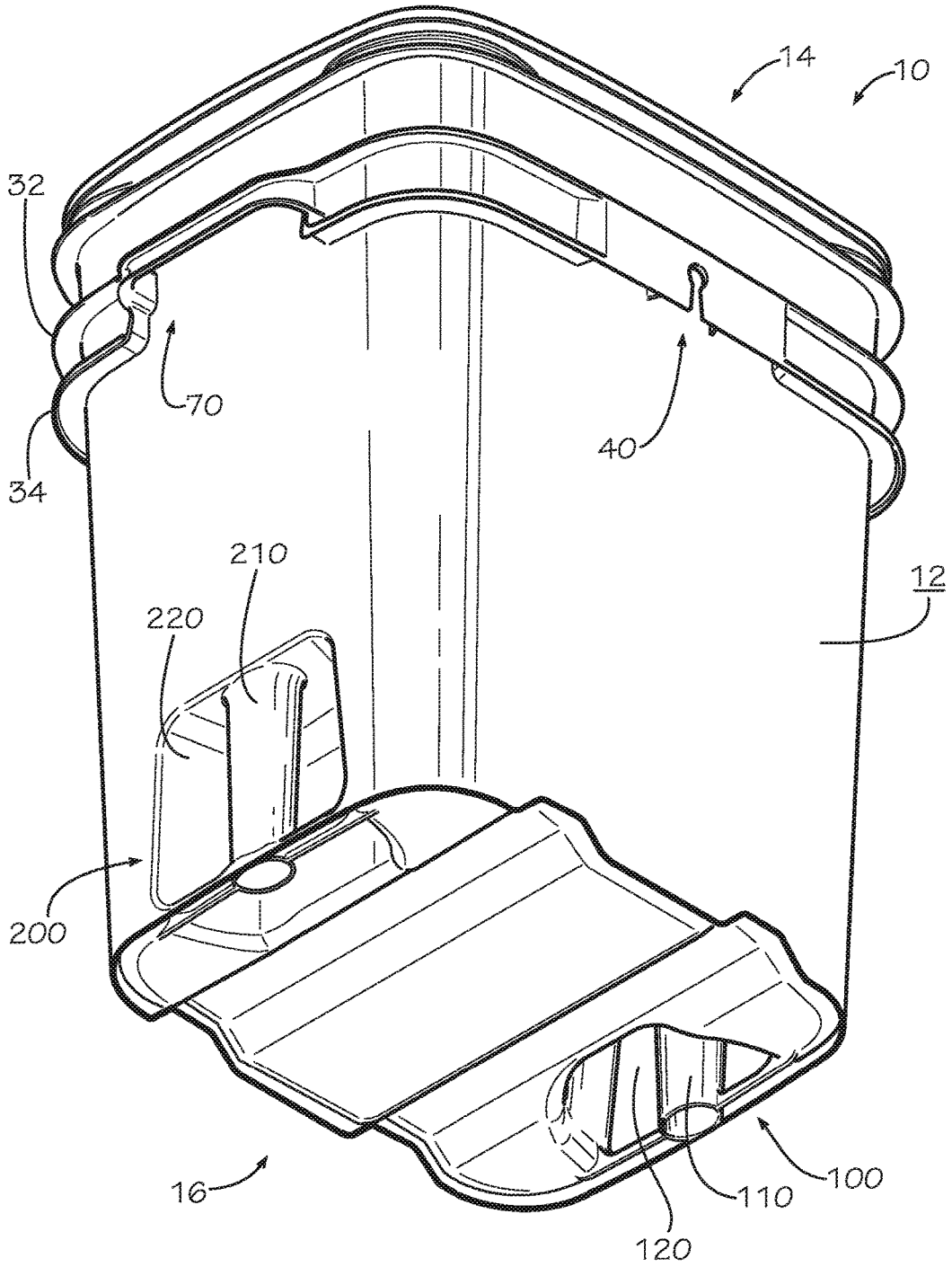
FIG. 9 is a second perspective view of the exemplary container of FIG. 1, according to one embodiment of the present disclosure.

FIG. 9 depicts a second perspective view of the exemplary container 10 of FIG. 1. As can be seen in this particular view, in various embodiments, the left hand cavity 220 and the right hand cavity 120 may extend through the bottom of the exemplary container 10. In an embodiment not shown, the left hand cavity 220 and the right hand cavity 120 may not extend through the bottom of the exemplary container 10. As further shown in the embodiment of FIG. 9, the lower left hand-grip 210 and the lower right hand-grip 110 may be generally oval in shape. As will be understood by one of ordinary skill in the art, the lower left hand-grip 210 and the lower right hand-grip 110 may be any suitable shape that enables a consumer to grab the handles.

Figure 10:
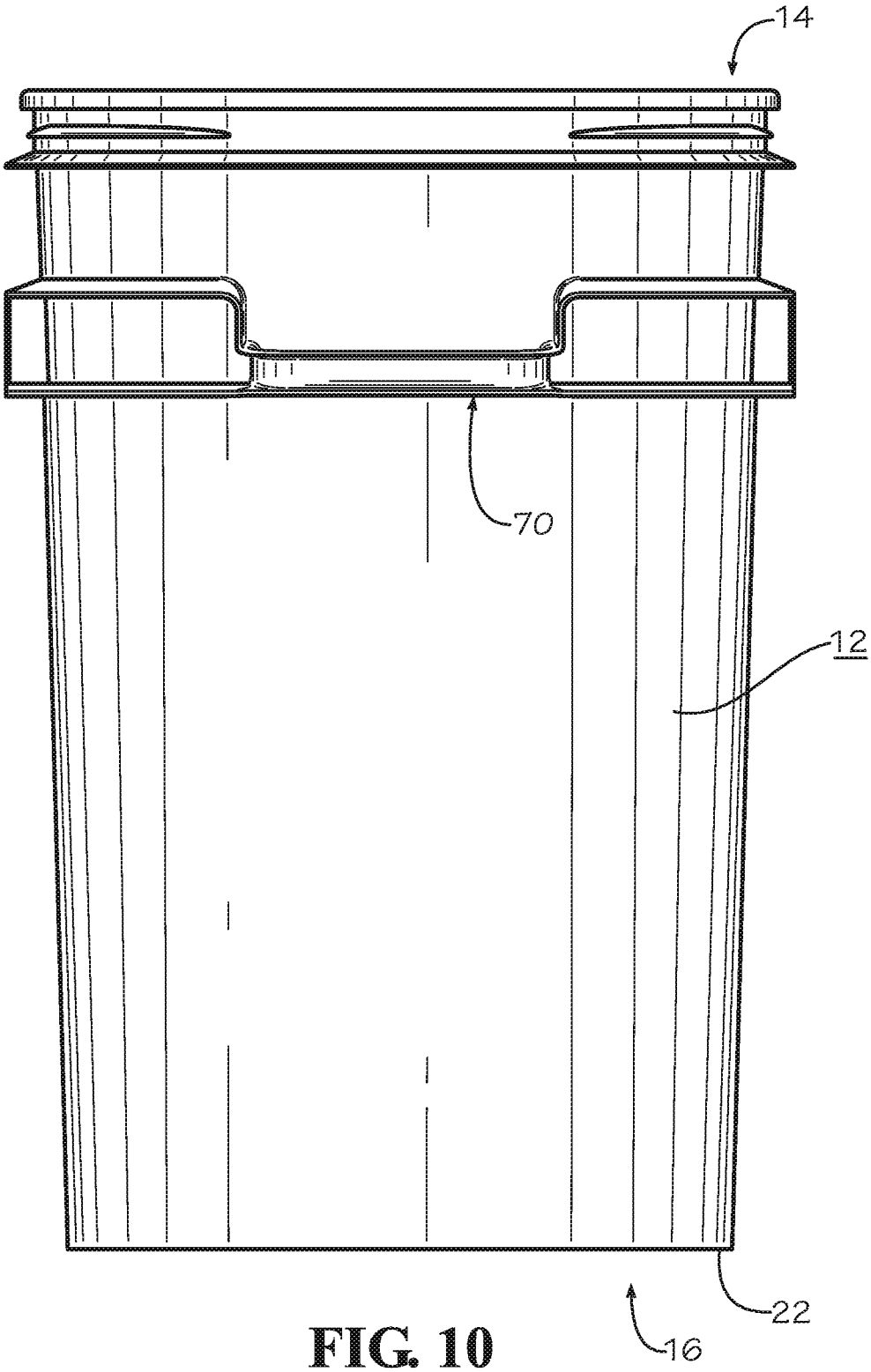
FIG. 10 is a side view of a fourth alternate exemplary container, according to one embodiment of the present disclosure.
Figure 12:
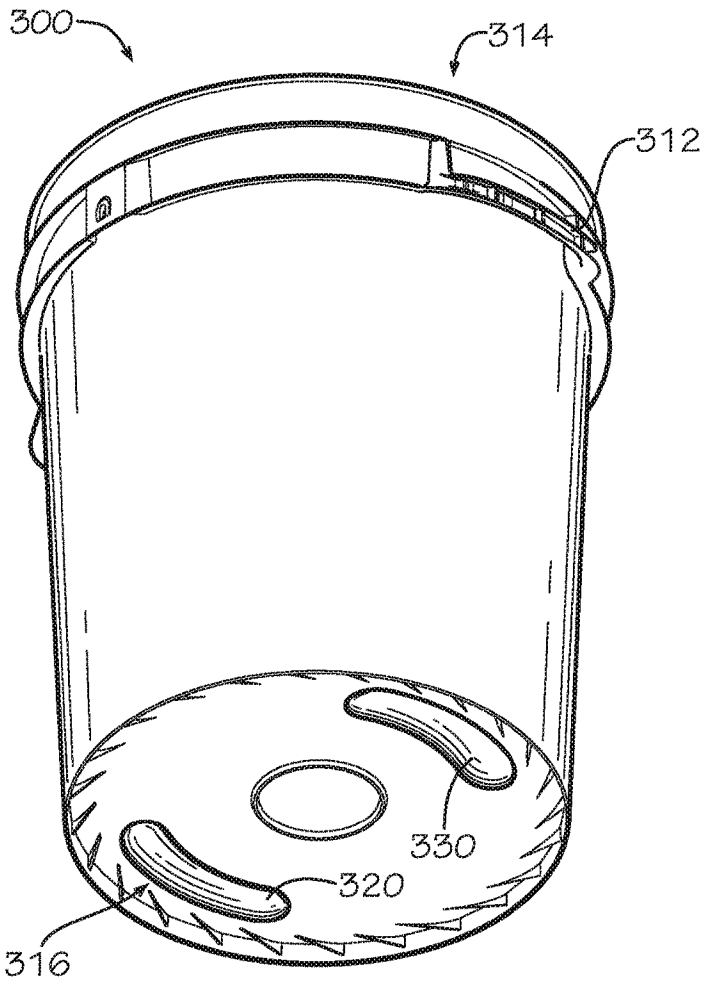
FIG. 12 is a perspective view of the exemplary round container of FIG. 11, according to one embodiment of the present disclosure.
Figure 11:
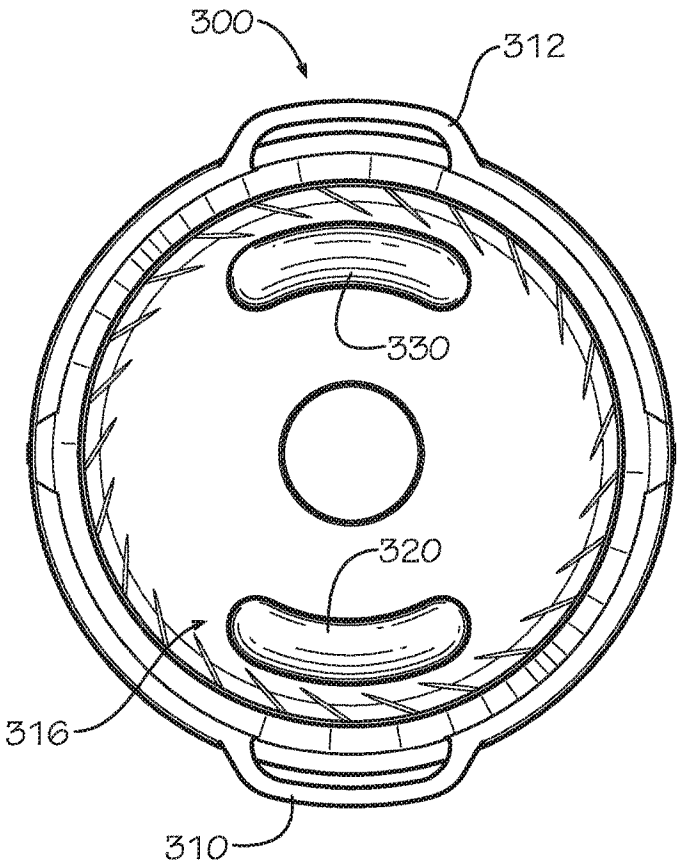
FIG. 11 is a bottom view of an exemplary round container, according to one embodiment of the present disclosure.

FIGS. 10-12 depict further alternate embodiments of an exemplary container. FIG. 10 depicts an exemplary container with at least one upper handle (e.g., the upper right handle 60 or the upper left handle 70), but no lower hand-grip assemble (e.g., the lower right hand-grip assembly 100 or the lower left hand-grip assembly 200).

FIGS. 11-12 depict an exemplary container 300 that is circular in shape. In the particular embodiment shown, the exemplary container 300 has a proximal end (top) 314, a bottom surface 316, upper handles 310 and 312, and lower hand-grips 320 and 330. In various embodiments, the upper handles 310 and 312 are substantially similar to the upper handles as described in relation to the exemplary container 10 discussed regarding FIGS. 1-10. In at least one embodiment, the upper handles 310 and 312 are vertically offset similar to the way the upper right handle 60 and the upper left handle 70 are offset in particular embodiments of the exemplary container 10; e.g., an upper surface of the upper handle 310 is a first particular distance from the proximal end 314 of the exemplary container 300 and an upper surface of the upper handle 320 is a second particular distance from the proximal end 314 of the exemplary container 300 (the upper handles 310 and 312 are not shown as offset in FIGS. 11-12). In one or more embodiments, the upper surfaces of the upper handles 310 and 312 are substantially the same vertical distance from the proximal end 314 of the exemplary container 300.

In the embodiment shown in FIGS. 11 and 12, the exemplary container 300 includes the lower hand-grips 320 and 330. In various embodiments, each of the lower hand-grips 320 and 330 are semi-circular and extend from the bottom surface 316 of the exemplary container 300 toward an interior of the exemplary container 300. As will be understood by one of ordinary skill in the art, each of the lower hand-grips 320 and 330 may extend toward the interior of the exemplary container 300 any suitable distance for a consumer to pick up the bottom of the exemplary container 300 via one or more of the lower hand-grips 320 and 330 (e.g., each of the lower hand-grips 320 and 330 may extend toward the interior of exemplary container approximately 0.1 inches to 4 inches as measure from the bottom surface 316 to the point of the lower hand-grip that extends the furthest into the interior of the exemplary container 300.

The lower hand-grips 320 and 330 may be any suitable shape and in any suitable location. In a particular embodiment, as shown, the lower hand-grips 320 and 330 are semi-circular cavities formed by the bottom surface 316 of the exemplary container 300. In at least one embodiment, the lower hand-grips 320 and 330 are circular, rectangular, oval, triangular, obround, or any other suitable shape (not shown). In one or more embodiments, there is only a single lower hand-grip formed by the bottom surface 316 of the exemplary container 300 (this single lower hand-grip may be any suitable shape, such as semi-circular, circular, rectangular, oval, etc.).

Figure 19:
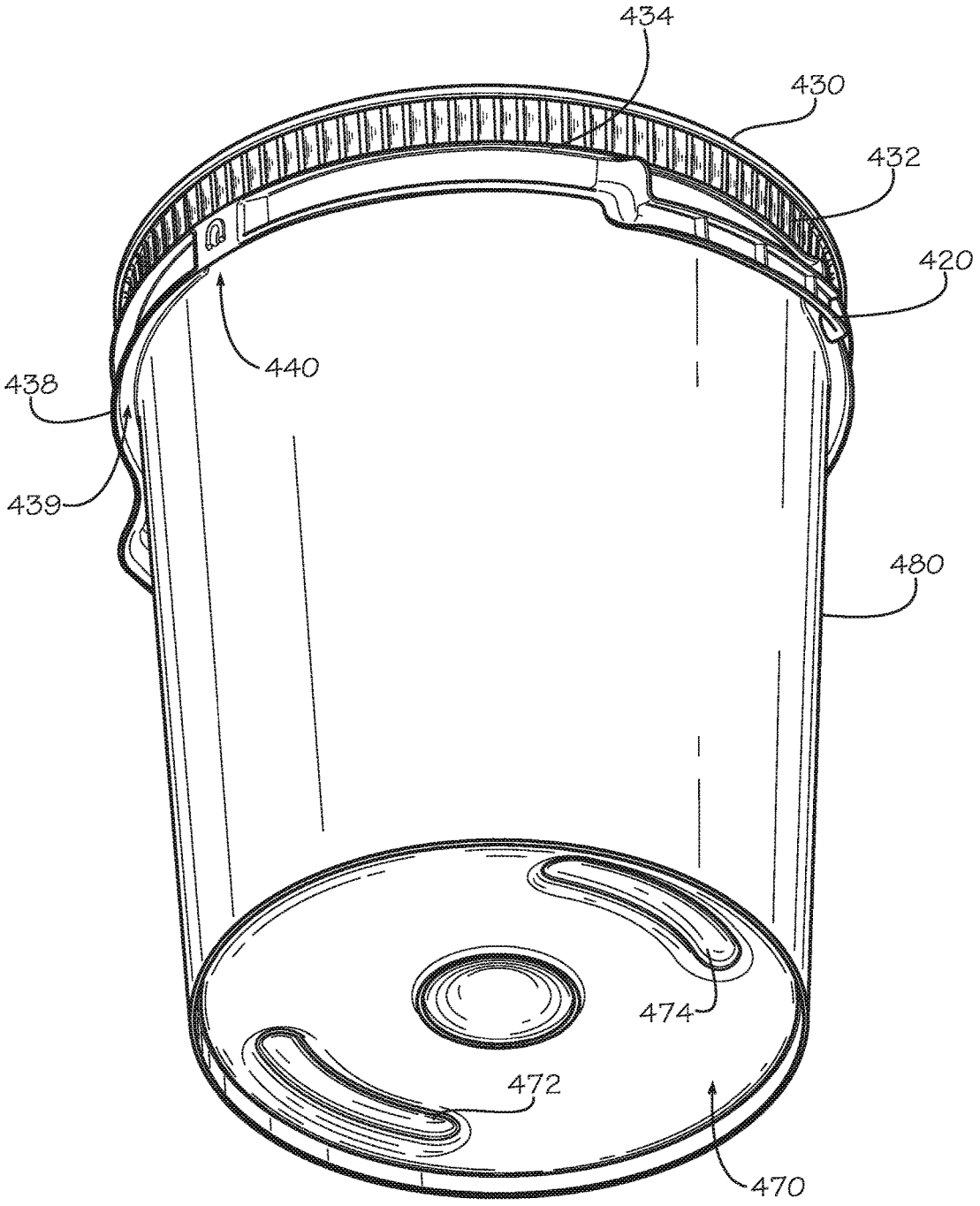
FIG. 19 is a perspective view of the exemplary round container of FIG. 13, according to one embodiment of the present disclosure.
Figure 20:
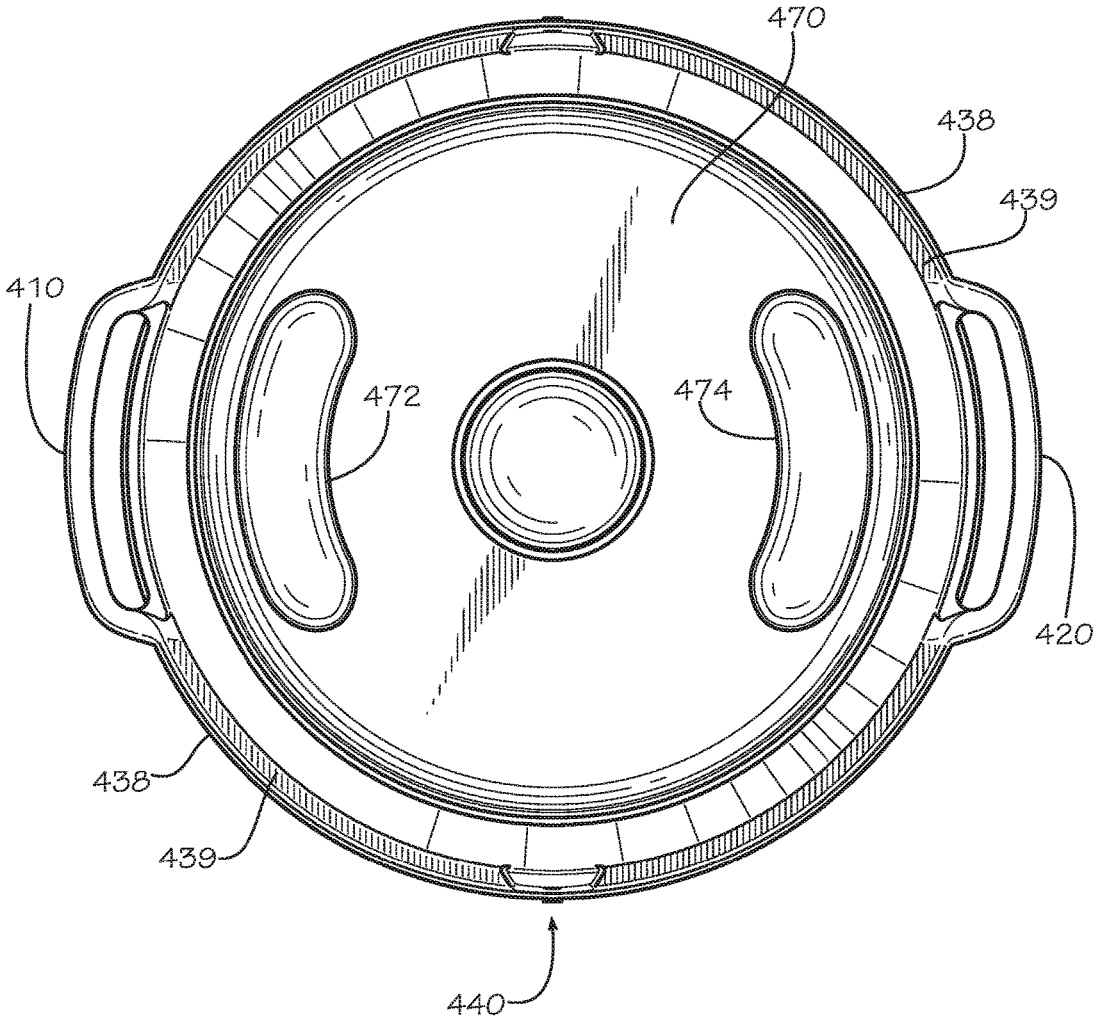
FIG. 20 is a bottom view of the exemplary round container of FIG. 13, according to one embodiment of the present disclosure.
Figure 21:
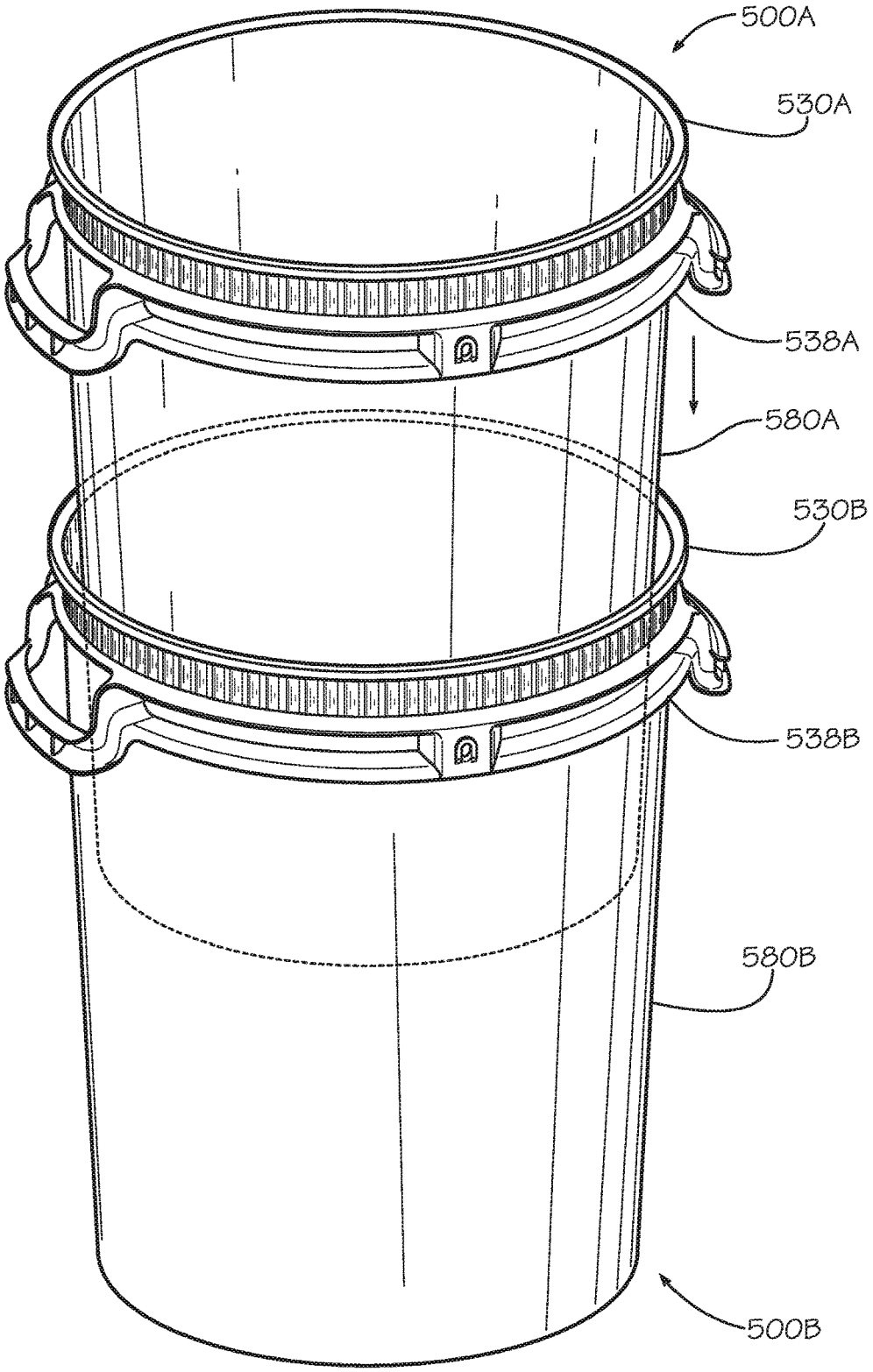
FIG. 21 is a perspective view of two exemplary round containers in a partially nested position, according to one embodiment of the present disclosure.
Figure 22:
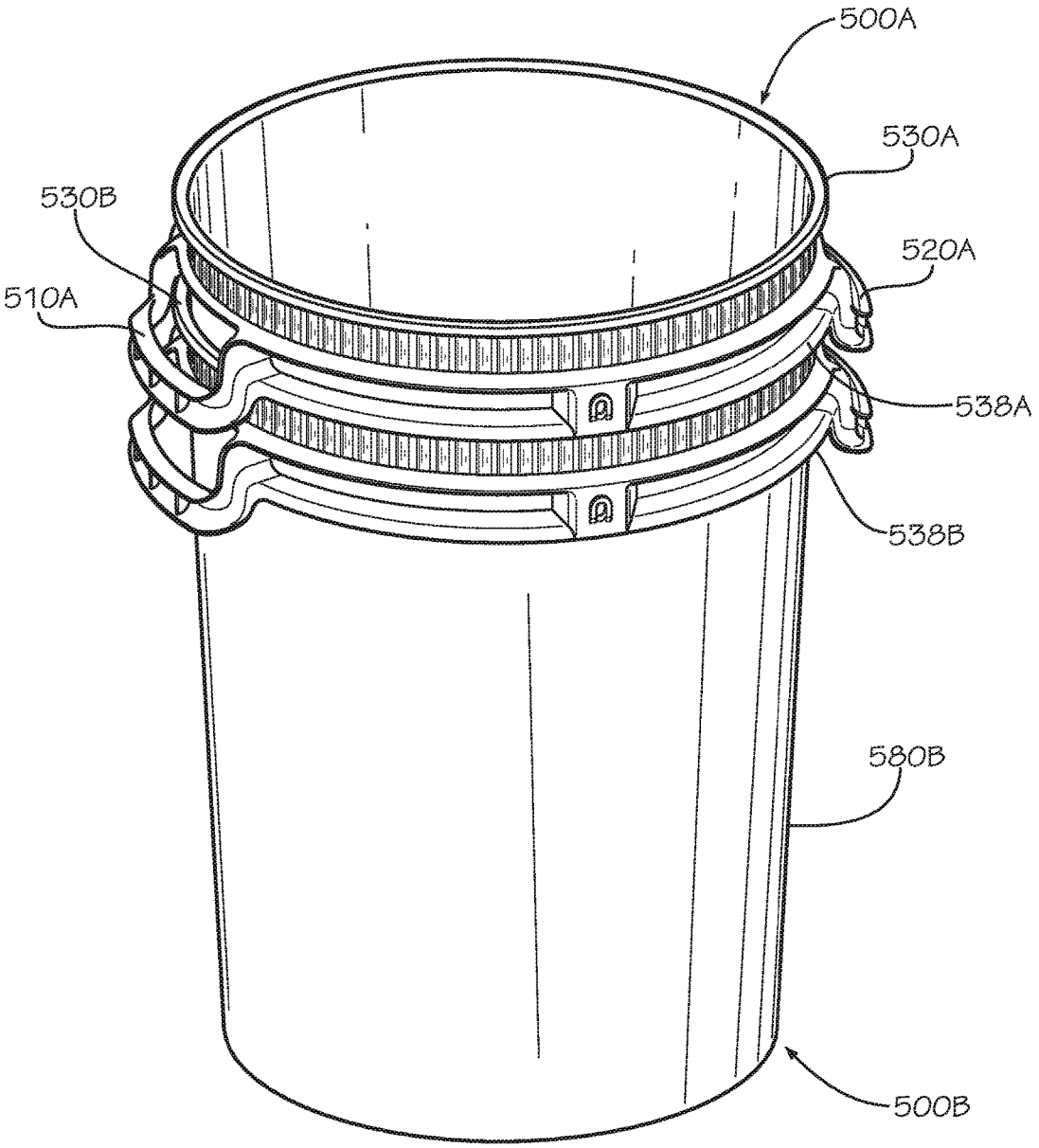
FIG. 22 is a perspective view of the two exemplary round containers of FIG. 21 in a fully nested position, according to one embodiment of the present disclosure.

FIGS. 13-22 depict a round container according to one embodiment of the present disclosure. More particularly, FIGS. 13-20 depict various exemplary features of a round container 400 and FIGS. 21-22 depict exemplary round containers 500A and 500B shown in partially nested and fully nested positions. As will be understood from discussions herein, although an exemplary round container is shown and discussed below, the exemplary container may be any shape container, including a container that is substantially rectangular, tapered rectangular, conical, tapered conical, square, tapered square, etc. and the features discussed below may be included in any such container. Further discussion regarding exemplary round containers 400, 500A, and 500B can be found below.

Figure 13:
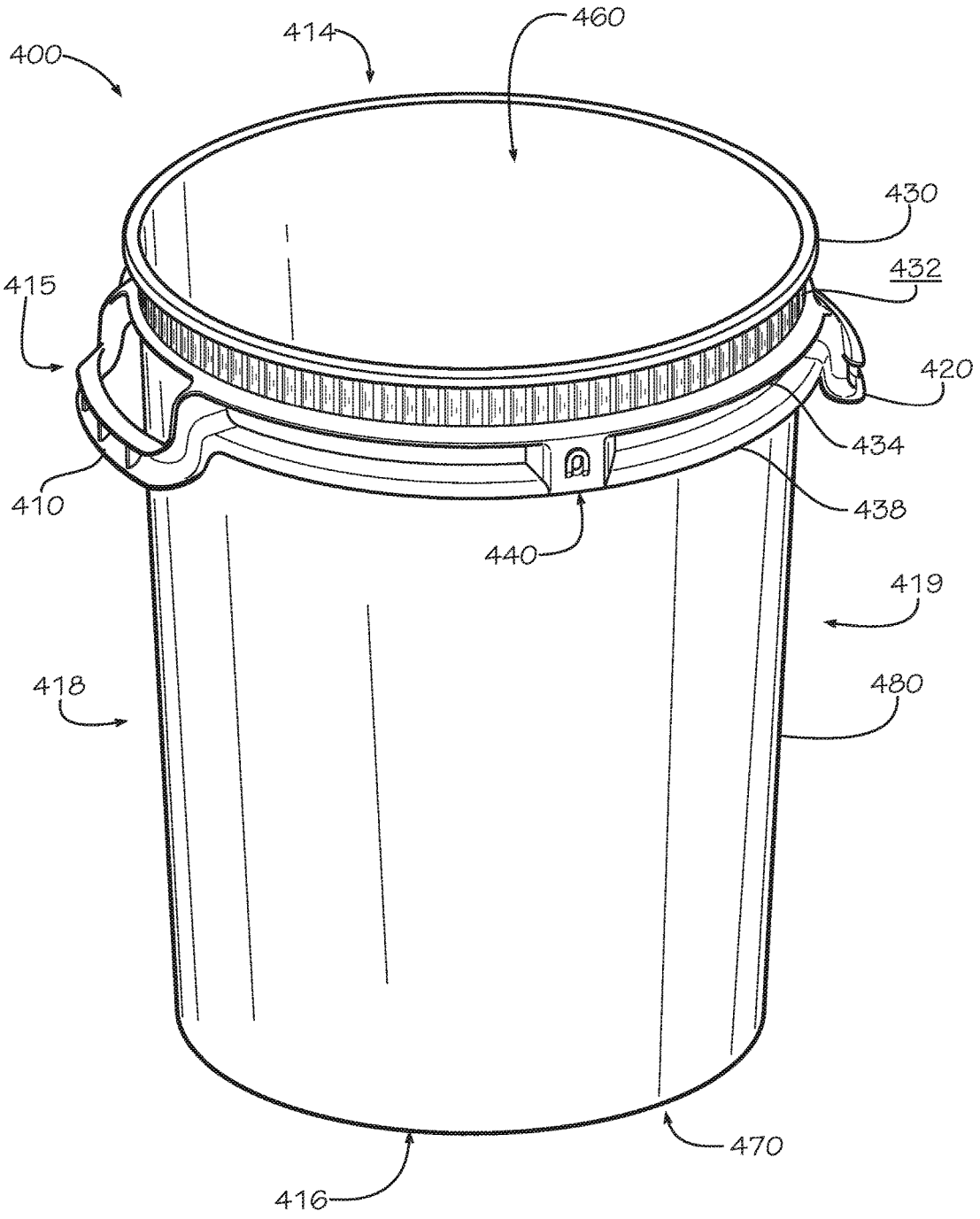
FIG. 13 is a perspective view of an exemplary round container, according to one embodiment of the present disclosure.

Turning to FIG. 13, the exemplary round container 400 is shown. In the embodiment shown, the exemplary round container 400 includes a container body 480 with a proximal end 414 (top), a distal end 416 (bottom), a left side 418, and a right side 419. In the embodiment shown, the exemplary round container 400 includes a substantially circular bottom 470 proximate the distal end 416 for sealing the exemplary round container 400 and defining an interior cavity. The exemplary round container 400, in particular embodiments, includes an opening 460 near the proximal end 414. As will be understood from discussions herein, the exemplary round container 400 may be used to transport various goods (including solids and/or liquids) by filling the exemplary round container 400 via the opening 460. In some embodiments, the exemplary container 400 may be sealed at the proximal end 414 via a lid that affixes to the exemplary round container via an upper lip 430.

The upper lip 430, in particular embodiments, is integrally formed with a portion of the sidewall of the container body 480 and traverses the circumference of the proximal end 414 of the exemplary round container 400. As will be further discussed herein, in some embodiments, the upper lip 430 is shaped such that it can be inserted in a satellite ring of a second round container when the exemplary round container 400 is nested with the second round container (e.g., as shown and described in regards to FIGS. 21 and 22). In further embodiments, the upper lip 430 has a cross-sectional shape that substantially conforms to the shape of a lower satellite ring (e.g., lower satellite ring 438). In various embodiments, the upper lip 430, as mentioned above, is shaped such that a lid attaches to the upper lip 430, at least partially sealing any contents of the exemplary round container 400 within the container.

In various embodiments, the exemplary round container 400 includes one or more features near the proximal end 414. In particular embodiments, the exemplary round container 400 includes a corrugated portion 432 of the container body 480 and a bumper assembly 415, which includes satellite rings 434 and 438, left and right handles 410 and 420, and at least one bail ear assembly 440 (further described below in regards to FIG. 14). As will be understood from discussions herein, the exemplary round container 400 may include any suitable features near the proximal end 414 (or in any suitable location), such as, for example, more than two satellite rings, multiple corrugated sections, more handles (or less handles), handles in different configurations than that shown and discussed herein, and/or other types of support structures not shown.

Continuing with FIG. 13, in the embodiment shown, the corrugated portion 432 extends from the upper lip 430 to an upper satellite ring 434 and includes a portion of the container body 480 with ridges and/or grooves to increase the strength of the container body 480. As will be understood by one of ordinary skill in the art, certain areas of a container may experience more stress, such as, for example, an area between an upper lip and a satellite ring, particularly if the upper lip is configured to receive a lid or a cover for the container. In such embodiments, it may be advantageous to reinforce or strengthen this portion of the container, such as by including a corrugated portion of the sidewall of the container, as shown by the corrugated portion 432. In various embodiments, portions of the container body 480 may be reinforced or strengthened by a mechanism other than corrugation, such as by including a thicker sidewall, by including a weave of the same or another material, etc.

As mentioned above, the corrugated portion 432 of the container body 480 terminates opposite the proximal end 414 at the upper satellite ring 434. In various embodiments, the upper satellite ring 434 extends outwardly from the container body 480 at an acute angle to the sidewall in a downward direction (e.g., the angle of the upper satellite ring is acute between a lower surface of the upper satellite ring 434 and the container body 480). As further discussed below, in various embodiments, at least a portion of the upper satellite ring 434 integrally forms an upper surface of the left handle 410 and an upper surface of the right handle 420 (which will be further discussed in regards to FIG. 15).

In the embodiment shown in FIG. 13, the bumper assembly 415 includes a lower satellite ring 438. In various embodiments, the lower satellite ring 438 extends outwardly from the container body 480 and is shaped to receive an upper lip of a second container (as will be further discussed herein). In particular embodiments, the lower satellite ring 438 integrally forms at least a portion of the left handle 410 and the right handle 420 (which will be further discussed in regards to FIG. 15).

Figure 14:
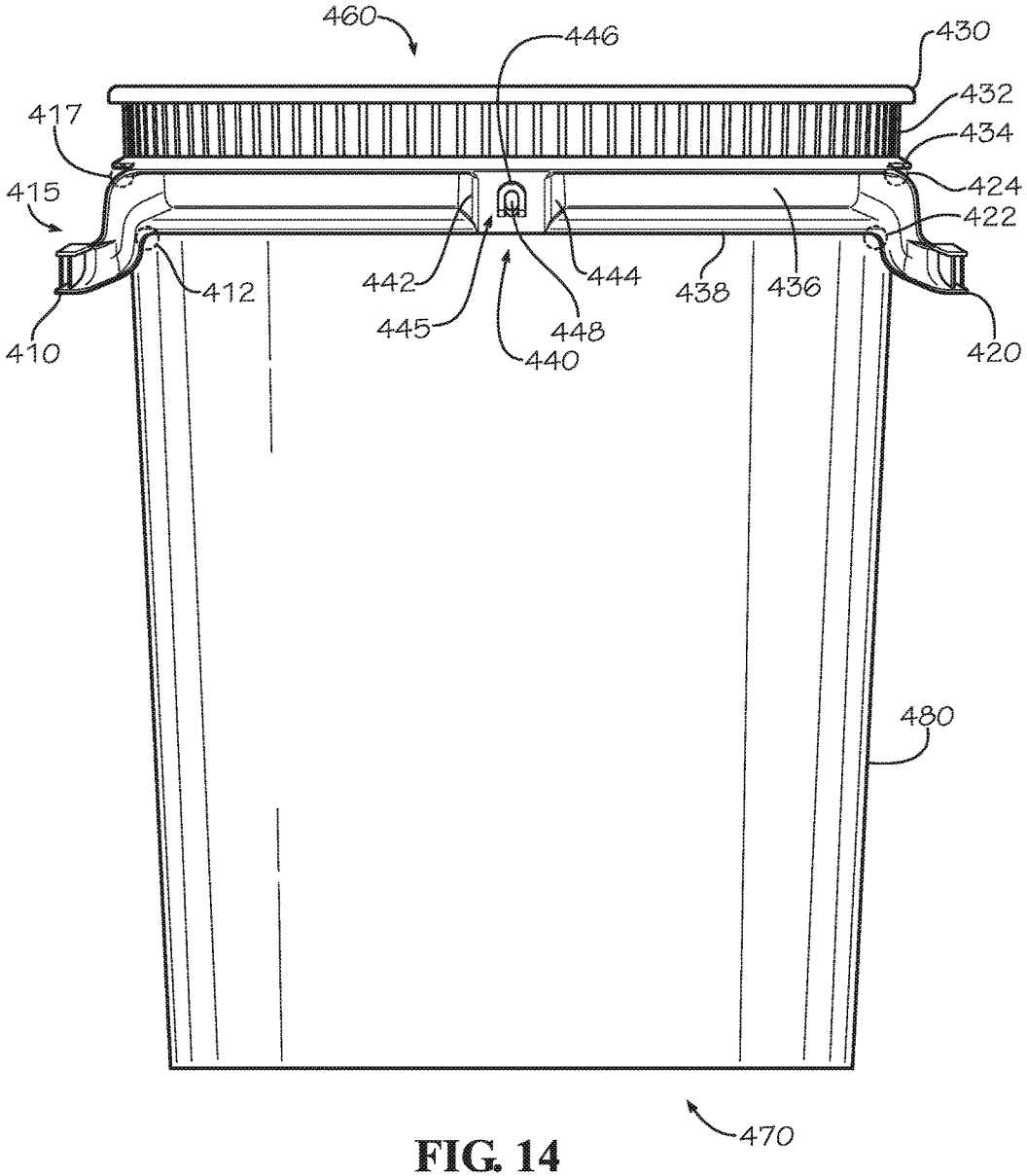
FIG. 14 is a front view of the exemplary round container of FIG. 13, according to one embodiment of the present disclosure.

Turning now to FIG. 14, this figure shows a front view of the exemplary round container 400. As discussed above, the exemplary round container 400 includes the upper lip 430, corrugated portion 432, and bumper assembly 415. As shown in FIG. 14, in various embodiments, the upper lip 430 extends outwardly from the container body 480 (from the corrugated portion 432) such that a lid may be affixed to the top of the exemplary round container 400.

As further shown in FIG. 14, the upper satellite ring 434 and lower satellite ring 438 of the bumper assembly 415 extend outwardly from the container body 480 and form the left and right handles 410 and 420. In various embodiments, at least of a portion the upper satellite ring 434 and a portion of the lower satellite ring 438 integrally form at least a portion of the left and right handles 410 and 420. In various embodiments, a portion of the upper satellite ring 434 forms downward slopes 417 and 424 and an upper surface of the left handle 410 and an upper surface of the right handle 420, respectively. In at least one embodiment, a portion of the lower satellite ring 438 forms downward slopes 412 and 422 and a lower surface of the left handle 410 and a lower surface of the right handle 420. As further discussed in regards to FIG. 15 and FIGS. 21-22, in various embodiments, the left handle 410 and right handle 420 extend downwardly below the lowest point of the lower satellite ring 438 to help "lock" the exemplary round container 400 with a second round container when in a fully nested position.

Continuing with FIG. 14, the bumper assembly 415 includes the bail ear assembly 440, which, in the embodiment shown, includes a vertical support 445 parallel to the container body 480, support structures 442 and 444, an opening 448, and an opening support portion 446. The vertical support 445, in various embodiments, defines the opening 448, which extends through the vertical support 445. In particular embodiments, the opening 448 is configured to receive the end of a handle that is affixed to the exemplary round container 400 via a bail ear assembly on the front and back sides of the exemplary container 400 (e.g., for carrying the exemplary round container 400). The opening 448 may be any suitable shape, including, for example, substantially round, substantially oval, rectangular, triangular, etc. As will be understood from discussions herein, the opening 448, in some embodiments, is a circular opening in the vertical support 445, with a perimeter completely defined by the vertical support 445. In one or more embodiments, the perimeter of the opening 448 is only partially defined by the vertical support 445, such that at least a portion of the perimeter of the opening 448 extends beyond the bottom of the vertical support 445 (e.g., such as the bail ear assembly described in regards to FIG. 1, herein).

According to particular embodiments, the vertical support 445 defines the opening support portion 446. As mentioned above, in various embodiments, the bail ear assembly 440 may function to receive and support a handle (not shown) for carrying the exemplary round container 400. In such embodiments (and others), the support portion 446 may function to further support the handle, reinforcing the opening 438 against stress provided by the handle when the exemplary round container 400 is carried. In various embodiments, the support portion 446 includes a U-shaped portion of extra material around a portion of the perimeter of the opening 448 (e.g., the material of the vertical support 445 is thicker at the support portion 446 than in other areas). In at least one embodiment, the support portion 446 may extend around the entire perimeter of the opening 448.

Figure 15:
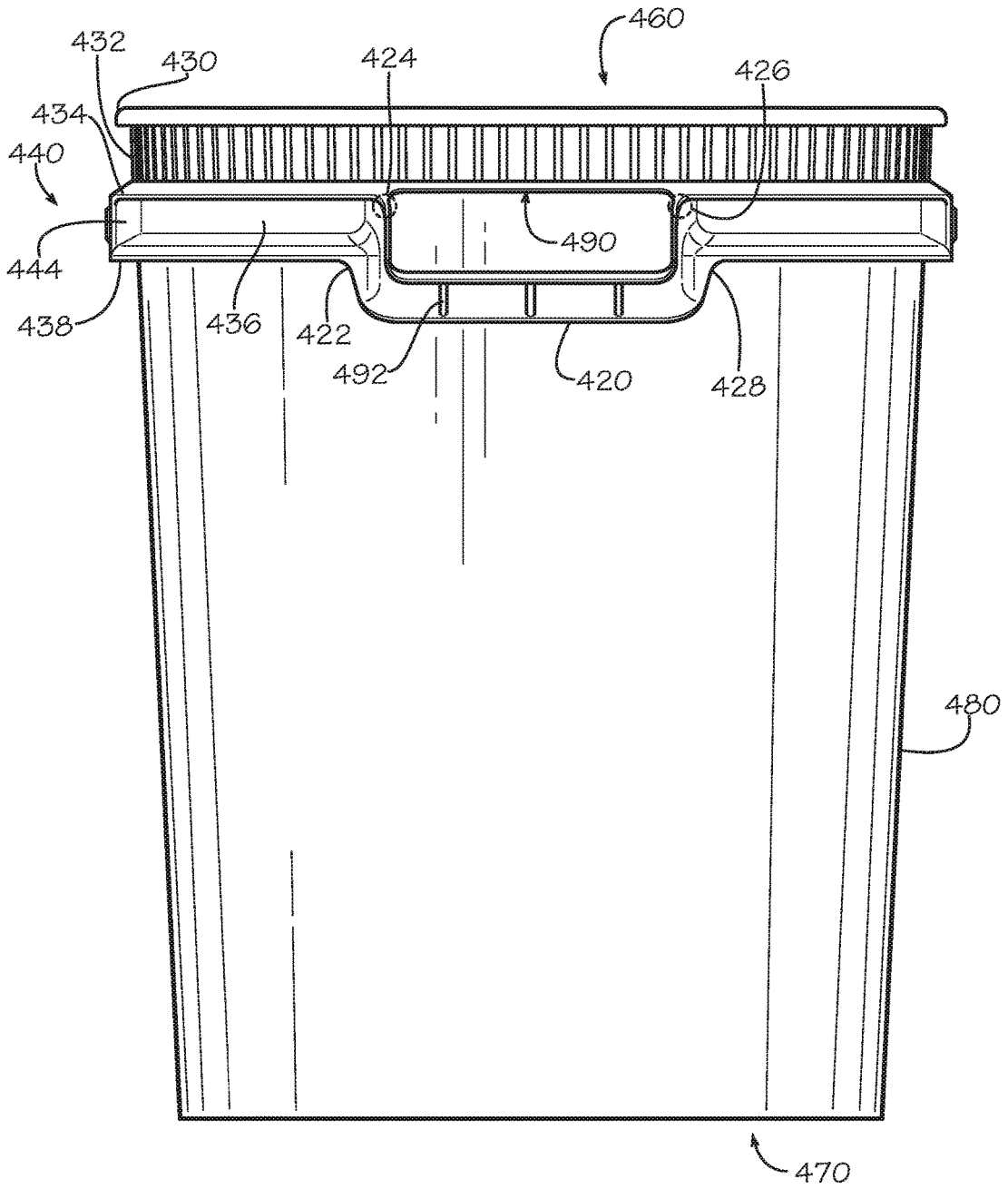
FIG. 15 is a side view of the exemplary round container of FIG. 13, according to one embodiment of the present disclosure.

Turning to FIG. 15, the figure shown is a view of the right side of the exemplary container 400. For the sake of brevity, only the right side of the exemplary container 400 is shown and described. It will be understood from discussions herein that the left side of the exemplary container 400 may be substantially the same as the right side, such that the left handle 410 may be substantially the same as the right handle 420. Thus, only the right handle 420 is described below.

In various embodiments, the right handle 420 is at least partially formed by the upper and lower satellite rings 434 and 438. In the embodiment shown, a portion of the upper satellite ring 434 includes a bend at an approximately 90 degree angle downward at 424 and 426. In various embodiments, the outermost portion of the upper satellite ring 434 includes a bend down and outward at 424 and 426 to integrally form the upper portion of the right handle 420 and the remaining portion of the upper satellite ring 434 continues as an upper satellite ring portion 490 through the gap between the right handle 420 and the container body 480. In the embodiment shown, about 60% of the upper satellite ring 434 is bent down and outward at 424 and 426 to integrally form the upper portion of the right handle 420 and the remaining 40% of the upper satellite ring 434 continues as a less protruding upper satellite ring 490 as described above. In various embodiments, the percentage of the upper satellite ring 434 that is bent down and outward at 424 and 426 to integrally form the upper portion of the right handle 420 may be any suitable percentage.

In some embodiments, the entire lower satellite ring 438 includes a substantially downward bend at 422 and 428 to integrally form at least a portion of the bottom of the right handle 420. In various embodiments, the lower satellite ring 438 includes a bend at 422 and 428 that is less than a 90 degree angle. As will be understood from discussions herein, the bends at 422 and 428 may be of any suitable angle.

In various embodiments, the right handle 420 may include support structures 492. In some embodiments, the support structures 492 may connect the upper and lower portions of the right handle 420 and be positioned in various orientations relative to the upper and lower portions of the right handle 420. In other embodiments, the support structures 492 may be a single support structure positioned in various orientations relative to the upper and lower portions of the right handle 420. In some embodiments, the support structures 492 may be manufactured of plastic (e.g., polyethylene, high-density polyethylene, etc.), metal, or another material.

In the embodiment shown, the right handle 420 extends below the lowest point of the lower satellite ring 438 so that there is a distance between the lower satellite ring 438 and the upper most part of the right handle 420. This distance between the lower satellite ring 438 and the upper most part of the right handle 420 creates an unoccupied space which may add functionality by making it easier for an external body (e.g., human hand, hook, etc.) to latch onto the right handle 420. The distance between the lower satellite ring 438 and the upper most part of the right handle 420 may facilitate better stacking of two containers by allowing for an upper lip of a second exemplary round container to nest into the region under the lower satellite ring 438 and above the right handle 420. The nesting mentioned above may occur when two containers, for example the exemplary round container 400 shown and another substantially similar container, interconnect in a stacked position as shown in FIG. 22.

Figure 16:
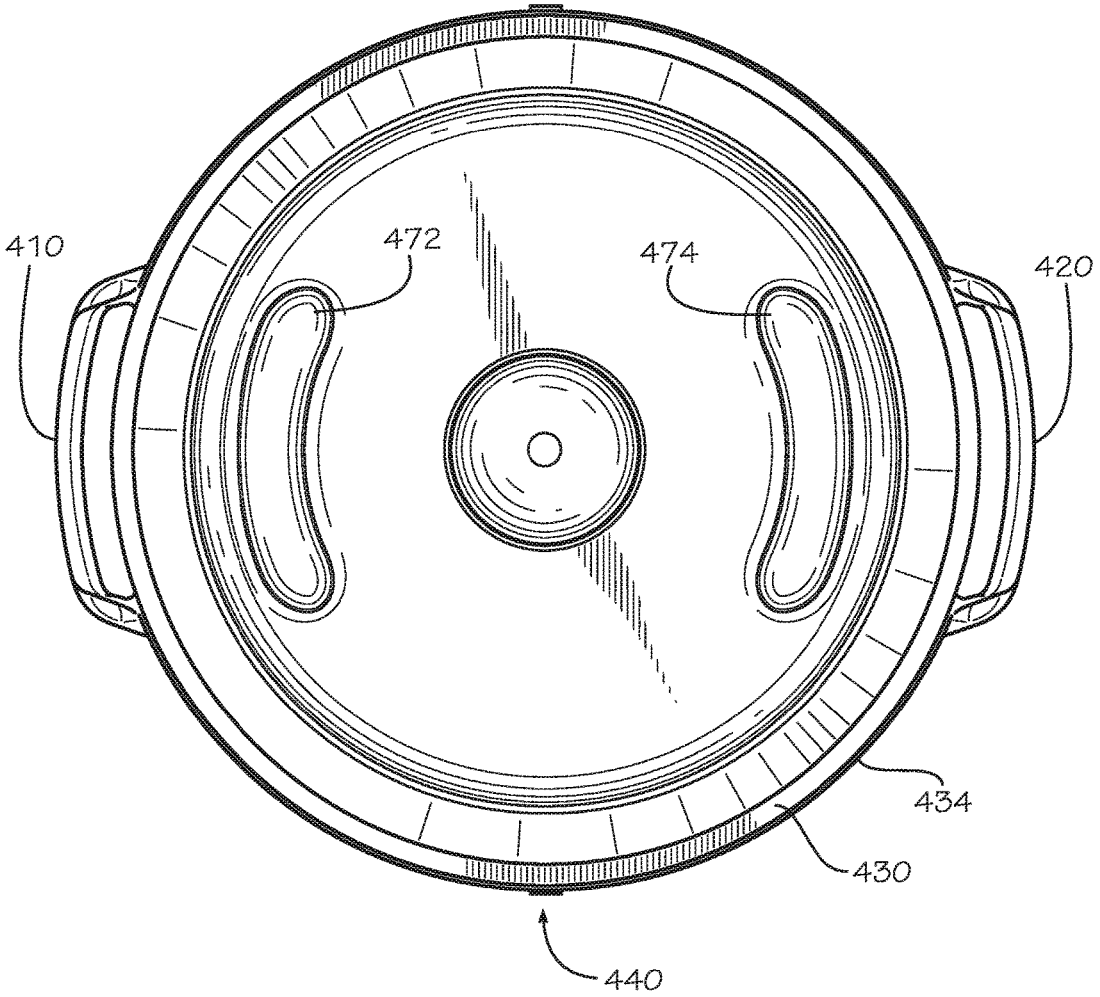
FIG. 16 is a top view of the exemplary round container of FIG. 13, according to one embodiment of the present disclosure.

Turning now to FIG. 16, a top view of the exemplary round container 400 is shown (e.g., from the perspective of viewing into the exemplary round container 400 and showing an interior surface of the bottom). In this embodiment, the substantially circular bottom 470 of the container at least partially includes the left and right arcuate lower hand grips 472 and 474. The arcuate lower hand grips 472 and 474, as shown in the present embodiment, resemble a curvature similar to that of the left and right handles 410 and 420 and each arcuate lower handle grip 472 and 474 occupies about 10% of the surface area of the substantially circular bottom 470 of the container. As will be understood from discussions herein, the left and right arcuate lower hand grips 472 and 474, in some embodiments, protrude upward from the substantially circular bottom 470 of the container into the volume encompassed by the container body 480, thus decreasing the overall volume of the container. In various embodiments, the left and right arcuate lower hand grips 472 and 474 may occupy more or less surface area and may protrude more or less than in the embodiment shown.

Continuing with FIG. 16, the protrusion radially outwardly of the upper satellite ring 434 and the upper lip 430 is shown. In the embodiment shown in this figure, the upper satellite ring 434 protrudes outward beyond the outer most part of the upper lip 430. Also shown in this embodiment, the bail ear assembly 440 protrudes outward slightly beyond the upper lip 430.

Figure 17:
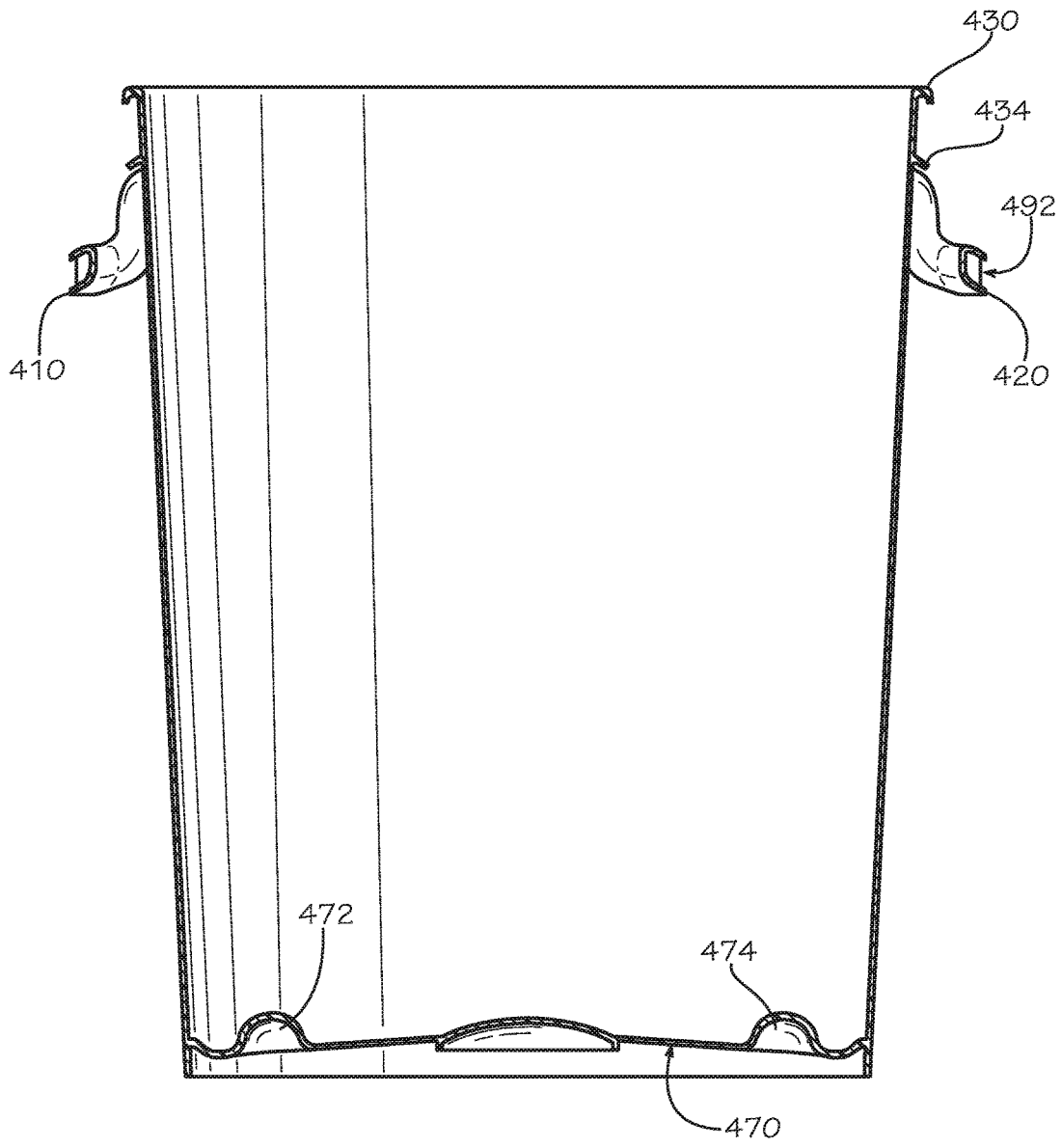
FIG. 17 is a partial cross-sectional view of the exemplary round container of FIG. 13, according to one embodiment of the present disclosure.

Turning to FIG. 17, this figure shows a cross-section of the exemplary round container 400. As shown in this embodiment, the lower arcuate hand grips 472 and 474 extend upwardly from the substantially circular bottom 470 of the container into the exemplary round container 400, as described above. In various embodiments, the storage volume of the exemplary round container 400 is decreased due to the lower arcuate hand grips 472 and 474. The upward protruding curvature of the lower arcuate handle grips 472 and 474 decreases the overall volume of the exemplary container 400 by approximately the same amount of volume that the lower arcuate handle grips 472 and 474 occupy. In various embodiments, the decrease in overall volume may be less or more relative to what is shown in the present embodiment.

In the present embodiment, the downward slope of the right handle 420 is shown. This downward slope of the right handle 420 may add leverage, comfort, or other forms of increased functionality for the user handling the container. Also potentially adding functionality are the lower arcuate hand grips 472 and 474. In the present embodiment, the lower arcuate hand grips 472 and 474 are shown protruding upward from the circular bottom 470 into the space encompassed by container body 480. In some embodiments, this upward protrusion may allow for the container operator to use the lower arcuate hand grips 472 and 474 for additional grip or leverage when handling the container. A container operator may use the lower arcuate hand grips 472 and 474 in conjunction with the left handle 410 or the right handle 420. It may be beneficial for a container handler to use a combination of the two sets of handles in conjunction in order to more easily tilt the container to empty the container of its contents. In various embodiments, it may be beneficial for a container handler to use the two handle sets in conjunction in order to better control the container if manipulating the container through a body of matter (e.g., liquids, solid particles, etc.) so as to at least partially fill the container with that matter.

Continuing with FIG. 17, in the present embodiment, the downward curvature of the upper lip 430 is shown. The convex curvature of the top portion of the upper lip 430 allows for the upper lip 430 to nest into the similar concave curvature of the under portion of a lower satellite ring 438 of another substantially similar container when stacked, as will be shown in FIG. 21.

Figure 18:
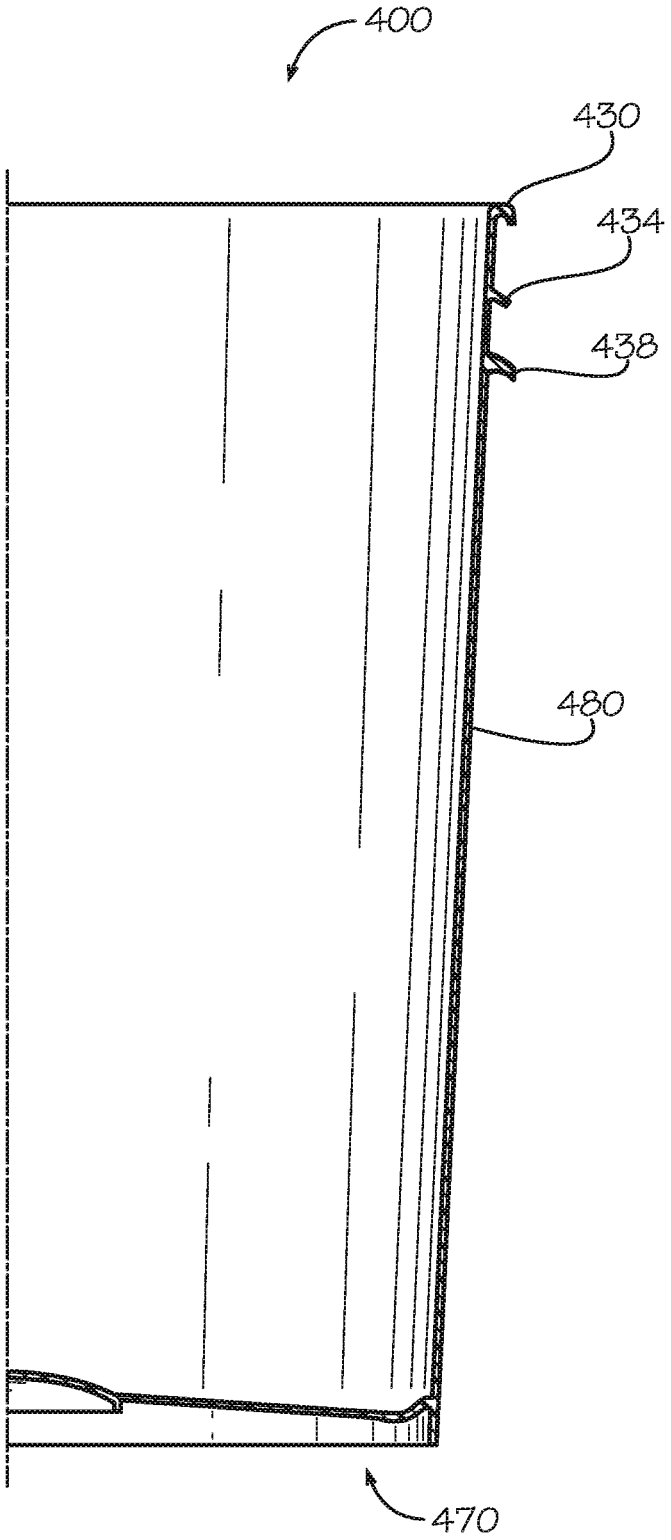
FIG. 18 is a partial cross-sectional view of the exemplary round container of FIG. 13, according to one embodiment of the present disclosure.

FIG. 18 depicts a cross-sectional view through a particular portion of the exemplary round container 400. In the present embodiment, the upper lip 430, the upper satellite ring 434, and the lower satellite ring 438 are shown protruding from the sidewall 480. In this embodiment, the upper lip 430 is integrally formed with the side wall 480 and includes a rounded upper portion transitioning to a downward convex bend, terminating with the end of the upper lip substantially parallel to the side wall 480. Also shown in this embodiment, the lower satellite ring 438 includes an upward concave bend that is shaped with substantially similar proportions to the convex bend of the upper lip 430. As will be further described herein, the upper lip 430 is shaped such that it will fit under the lower satellite ring of a substantially similar exemplary container, with the upper portion of the upper lip 430 in contact with a lower surface of the lower satellite ring of the substantially similar exemplary container when in a stacked position. In various embodiments, the upper satellite ring 434 extends downward at an acute angle from the sidewall 480. In some embodiments, the upper satellite ring 434 may include more or less protrusion and bend than shown in the present embodiment.

Turning to the embodiment shown in FIG. 19, the exemplary round container 400 is shown in a lower perspective view. In this figure, the underside of the lower satellite ring 438 is shown and indicated as receiving space 439. In the embodiment shown, the lower satellite ring 438 includes a lower concave surface shaped substantially similarly to the surface of the upper lip 430, as indicated at receiving space 439. As will be further discussed herein, the lower satellite ring 438 may be shaped at receiving space 439 to receive an upper lip 430 of a second exemplary round container (or any suitable container). Receiving the upper lip 430 of a second exemplary round container 400 (or any suitable container) may occur at this location under the lower satellite ring 438, indicated as receiving space 439. In various embodiments, the lower satellite ring 438 may continue around the container body 480 except for at the locations of the left and right handle 410 and 420 and the bail ear assembly 440. In particular embodiments, the left and right handle 410 and 420, and bail ear assembly 400, may include a similar shape (e.g., a concave surface shaped substantially similarly to the upper lip 430) for receiving an upper lip of a second exemplary round container.

The corrugated section 432 extending from the upper lip 430 to the upper satellite ring 434 may strengthen this region between the upper lip 430 and the upper satellite ring 434 in situations where the container may be stacked and experiencing additional stress.

Turning to FIG. 20, this figure shows a bottom view of the exemplary round container 400 in a particular embodiment. In this embodiment, the lower arcuate hand grips 472 and 474 are each shown occupying approximately 10% of the surface area of the substantially circular bottom 470. Continuing with this embodiment, the underside of the lower satellite ring 438 is shown at receiving space 439. In various embodiments, the underside of the lower satellite ring 438 may continue around the container body 480 except for at the locations of the bail ear assembly 440 and the left and right handles 410 and 420. In some embodiments, at the locations of the bail ear assembly 440 and the left and right handles 410 and 420, the lower satellite ring 438 at least partially forms these characteristics of the exemplary container 400.

Continuing with FIG. 20, in some embodiments, the left and right arcuate lower hand grips 472 and 474 may include non-slip grooves (or other surface finishes), divots for fingers, etc., which may further decrease the overall volume of the container but may add increased performance capabilities for the container handler. As will be understood from discussions herein, the lower hand grips 472 and 474 may be any suitable shape, including, but not limited to, substantially round, arcuate, substantially rectangular, etc.

Turning to FIG. 21, this figure depicts exemplary round containers 500A and 500B in a partially nested/stacked position. In the present embodiment, the lower satellite ring 538A of the exemplary round container 500A is positioned vertically above the upper lip 530B of the exemplary round container 500B so as to receive the upper lip 530B if the exemplary round container 500A is lowered onto the body of the exemplary round container 500B. As shown, a sidewall 580A of the exemplary round container 500A may slide into the body cavity of the second exemplary round container 500B.

FIG. 22 shows the two exemplary round containers 500A and 500B in a nested/stacked configuration, according to one particular embodiment. In the embodiment shown, the lower satellite ring 538A receives the upper lip 530B such that the upper lip 530B is nested with a lower concave surface of the lower satellite ring 538A. In some embodiments, the upper lip 530B is concealed underneath the lower satellite ring 538A when the two exemplary round containers 500A and 500B are in a stacked orientation. In other embodiments, the upper lip 530B is visible at the location of the left and right handles 510A and 520A. The contact between the lower satellite ring 538A and the upper lip 530B may provide stability when stacking and transporting multiple stacked containers. In certain embodiments, the right and left handles 510A and 520A hang over the upper lip 530B. In these embodiments (and others), the handles 510A and 520A may better secure the stacked containers and prevent the upper lip 530B from becoming dislodged from under the lower satellite ring 538A during transportation, storage, or any other environmental factor a container may be exposed to.

CONCLUSION

Accordingly, it will be readily understood by those persons skilled in the art that, in view of the above detailed description of the various embodiments and articles of the present disclosure, the present disclosure is susceptible of broad utility and application. Many methods, embodiments, and adaptations of the present disclosure other than those herein described, as well as many variations, modifications, and equivalent arrangements will be apparent from or reasonably suggested by the present disclosure and the above detailed description thereof, without departing from the substance or scope of the present disclosure. Accordingly, while the present disclosure is described herein in detail in relation to various embodiments, it is to be understood that this detailed description is only illustrative and exemplary of the present disclosure and is made for purposes of providing a full and enabling disclosure of the present disclosure. The detailed description set forth herein is not intended nor is to be construed to limit the present disclosure or otherwise to exclude any such other embodiments, adaptations, variations, modifications, and equivalent arrangements of the present disclosure. The scope of the present disclosure is defined solely by the claims appended hereto and the equivalents thereof.

What is claimed is:

1. A container comprising:

a substantially circular bottom a sidewall extending perpendicular from the substantially circular bottom and terminating with an integrally formed upper lip, wherein an upper portion of the sidewall defines an opening;

an upper satellite ring comprising a top surface and a bottom surface, the upper satellite ring extending outwardly from the sidewall at a downward angle at a first particular distance from the integrally formed upper lip;

a lower satellite ring extending outwardly from the sidewall and shaped to receive an upper lip of another container; and a left curved handle and a right curved handle integrally formed with the upper satellite ring and the lower satellite ring, wherein:

the left curved handle and the right curved handle each extend below the lowest point of the lower satellite ring;

the top surface of the upper satellite ring slopes downwardly from the first particular distance from the integrally formed upper lip to a second particular distance from the integrally formed upper lip to form a top surface of the left curved handle and a top surface of the right curved handle; and the second particular distance is below the bottom surface of the upper satellite ring.

2. The container of claim 1, wherein a radius of the right curved hand-grip is substantially parallel to a radius of the right curved handle.

3. The container of claim 1, wherein the container further comprises two bail ears formed between the upper satellite ring and the lower satellite ring.

4. The container of claim 1, wherein the left curved handle and the right curved handle each extend downwardly from the sidewall, then flare outwardly from the sidewall.

5. The container of claim 4, wherein:

the top surface of the upper satellite ring slopes downwardly from the first particular distance from the integrally formed upper lip and from a first point on the top surface of the upper satellite ring to the second particular distance from the integrally formed upper lip to form the top surface of the left curved handle;

the top surface of the upper satellite ring slopes downwardly from the first particular distance from the integrally formed upper lip and from a second point on the top surface of the upper satellite ring to the second particular distance from the integrally formed upper lip to form the top surface of the left curved handle; and the container comprises a continuous gap between the sidewall and the top surface of the left curved handle between the first point and the second point.

6. The container of claim 5, wherein:

the lower satellite ring comprises a lower surface; and the lower surface of lower satellite ring slopes downwardly to form a lower surface of the left curved handle.

7. The container of claim 6, wherein the top surface of the left curved handle is lower than the lower surface of the lower satellite ring at one or more points.

8. The container of claim 7, wherein the substantially circular bottom integrally forms a left arcuate hand-grip and a right arcuate hand-grip.

9. The container of claim 8, wherein the left arcuate hand-grip comprises a slope from the substantially circular bottom along a curved edge of the arcuate hand-grip substantially concentric with an outer edge of the substantially circular bottom to an apex of the left arcuate hand-grip.

10. A container comprising:

a substantially circular bottom defining at least one curved hand-grip by sloping from a bottom surface of the substantially circular bottom along a curved edge of the at least one curved hand-grip substantially concentric with an outer edge of the substantially circular bottom to an apex of the at least one curved hand-grip;

a sidewall extending perpendicular from the substantially circular bottom and terminating with an integrally formed upper lip, wherein an upper portion of the sidewall defines an opening;

an upper satellite ring coupled to the sidewall at a first particular distance below the upper lip, the upper satellite ring extending outward from the sidewall at a downward angle and comprising a top surface and a bottom surface;

a lower satellite ring coupled to the sidewall below the upper satellite ring, the lower satellite ring extending outward from the sidewall and shaped to receive an upper lip of another container; and at least one curved handle integrally formed with the upper and lower satellite rings, wherein:

the at least one curved handle extends below the lowest point of the lower satellite ring, the at least one curved hand-grip has a radius that is substantially parallel to a radius of the at least one curved handle;

the top surface of the upper satellite ring slopes from the first particular distance below the upper lip downwardly to a second particular distance from the upper lip to form a top surface of the at least one curved handle; and the second particular distance is below the bottom surface of the upper satellite ring.

11. The container of claim 10, wherein the least one curved handle comprises a left curved handle and a right curved handle.

12. The container of claim 11, wherein the at least one curved hand-grip comprises a left arcuate hand-grip and a right arcuate hand-grip.

13. The container of claim 12, wherein a radius of the right curved handle is substantially parallel to a radius of the right arcuate hand-grip.

14. The container of claim 13, wherein a radius of the left curved handle is substantially parallel to a radius of the left arcuate hand-grip.

15. The container of claim 10, wherein the lower satellite ring forms a substantially arc shape.

16. The container of claim 10, wherein the at least one curved hand-grip comprises less than 20% of the exterior surface of the substantially circular bottom.

17. The container of claim 10, wherein the at least one curved hand-grip comprises less than 30% of the exterior surface of the substantially circular bottom.

18. A container comprising:

a substantially circular bottom defining at least one arcuate hand-grip by sloping from a bottom surface of the substantially circular bottom along a curved edge of the at least one arcuate hand-grip substantially concentric to an outer edge of the substantially circular bottom to an apex of the at least one curved hand-grip;

a sidewall extending perpendicular to the substantially circular bottom and terminating with an integrally formed upper lip, wherein an upper portion of the sidewall defines an opening;

a satellite ring coupled to the sidewall below the upper lip, the satellite ring extending outward from the sidewall and shaped to receive an upper lip of another container at a first particular distance from the integrally formed upper lip; and at least one curved handle integrally formed with the satellite ring, wherein:

the at least one curved handle extends below the lowest point of the satellite ring, a radius of the at least one curved hand-grip is substantially parallel to a radius of the at least one curved handle and a radius of the satellite ring;

a lower surface of the satellite ring slopes downwardly from the first particular distance from the integrally formed upper lip to a second particular distance from the integrally formed upper lip to form a lower surface of the at least one curved handle; and the second particular distance is greater than the first particular distance.

19. The container of claim 18, wherein the container further comprises two bail ears operatively connected to the sidewall.

20. The container of claim 19, wherein the satellite ring is a first satellite ring and the container further comprises a second satellite ring, wherein a radius of the second satellite ring is substantially parallel to the radius of the at least one curved hand-grip.

21. The container of claim 20, wherein the second satellite ring is coupled to the sidewall below the upper lip, the second satellite ring extending outward from the sidewall at a downward angle.

22. The container of claim 21, wherein the two bail ears are formed between the first satellite ring and the second satellite ring.

23. The container of claim 18, wherein the satellite ring forms a substantially arc shape.

24. The container of claim 18, wherein the at least one arcuate hand-grip comprises less than 20% of the exterior surface of the substantially circular bottom.

25. The container of claim 18, wherein the at least one arcuate hand-grip comprises less than 30% of the exterior surface of the substantially circular bottom.

* * * * *